US012018599B1

(12) United States Patent
Alexandru et al.

(10) Patent No.: US 12,018,599 B1
(45) Date of Patent: Jun. 25, 2024

(54) VALVE ACTUATION SYSTEM COMPRISING ROCKER ASSEMBLIES WITH ONE-WAY COUPLING THEREBETWEEN

(71) Applicant: Jacobs Vehicle Systems, Inc., Bloomfield, CT (US)

(72) Inventors: Matei Alexandru, Simsbury, CT (US); John Mandell, Vernon, CT (US); Tyler Hines, Stafford Springs, CT (US); Justin D. Baltrucki, Canton, CT (US); Gabriel S. Roberts, Wallingford, CT (US); Bruce A. Swanbon, Tolland, CT (US); Robb Janak, Bristol, CT (US); G. Michael Gron, Jr., Windsor, CT (US); Marc B. Silva, Willington, CT (US); Austen P. Metsack, Ashford, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 18/540,611

(22) Filed: Dec. 14, 2023

Related U.S. Application Data

(60) Provisional application No. 63/387,944, filed on Dec. 17, 2022.

(51) Int. Cl.
*F01L 13/00* (2006.01)
*F01L 1/18* (2006.01)
(Continued)

(52) U.S. Cl.
CPC ..... *F01L 13/0036* (2013.01); *F01L 1/181* (2013.01); *F01L 1/185* (2013.01); *F01L 1/267* (2013.01);
(Continued)

(58) Field of Classification Search
CPC ..... F01L 1/181; F01L 1/185; F01L 2001/186; F01L 1/2411; F01L 1/267; F01L 1/46; F01L 2001/467; F01L 13/0036
(Continued)

(56) References Cited

U.S. PATENT DOCUMENTS 7,712,449 B1 * 5/2010 Schwoerer ..... F02D 13/04 123/90.15
2005/0274341 A1 12/2005 Usko et al.
(Continued)

FOREIGN PATENT DOCUMENTS

WO 2012015970 A1 2/2012
WO WO-2023034896 A1 * 3/2023

OTHER PUBLICATIONS

International Search Report for International application No. PCT/IB2023/062742, mailed on Mar. 19, 2024, 3 pages.
(Continued)

*Primary Examiner* — Jorge L Leon, Jr.
(74) *Attorney, Agent, or Firm* — Jordan IP Law, LLC

(57) ABSTRACT

A system for actuating at least two engine valves comprises a first rocker assembly operatively connected to a first valve actuation motion source and to a first engine valve. The first rocker assembly comprises a first lost motion component arranged in series with a first input rocker and a first output rocker. A second rocker assembly is operatively connected to a second valve actuation motion source and to a second engine valve. The second rocker assembly comprises at least one second rocker. The system further comprises a one-way coupling mechanism disposed between the first output rocker and the at least one second rocker such that second valve actuation motions are transferred from the at least one second rocker to the first output rocker, and first valve
(Continued)

actuation motions are not transferred from the first output rocker to the at least one second rocker.

26 Claims, 22 Drawing Sheets

(51) Int. Cl.
*F01L 1/26* (2006.01)
*F01L 1/46* (2006.01)
*F01L 1/24* (2006.01)

(52) U.S. Cl.
CPC ..... *F01L 1/46* (2013.01); *F01L 2001/186* (2013.01); *F01L 1/2411* (2013.01); *F01L 2001/467* (2013.01)

(58) Field of Classification Search
USPC ..... 123/90.4, 90.44, 90.46
See application file for complete search history.

(56) References Cited

U.S. PATENT DOCUMENTS

| | | | | |
|---|---|---|---|---|
| 2019/0293001 | A1* | 9/2019 | Baltrucki | F01L 13/065 |
| 2020/0182097 | A1 | 6/2020 | Alexandru | |
| 2020/0182103 | A1* | 6/2020 | Mandell | F01L 1/24 |
| 2021/0340891 | A1 | 11/2021 | Roberts | |

OTHER PUBLICATIONS

Written Opinion of the International Searching Authority for International application No. PCT/IB2023/062742, mailed on Mar. 19, 2024, 4 pages.

* cited by examiner

VALVE ACTUATION SYSTEM COMPRISING ROCKER ASSEMBLIES WITH ONE-WAY COUPLING THEREBETWEEN

FIELD

The present disclosure generally concerns internal combustion engines and, in particular, valve actuation systems comprising rocker assemblies with a one-way coupling therebetween.

BACKGROUND

Valve actuation in an internal combustion engine is required for the engine to operate. Typically, valve actuation forces to open the engine valves (i.e., intake, exhaust or auxiliary engine valves) are conveyed by valve trains where such valve actuation forces may be provided by main and/or auxiliary motion sources. As used herein, the descriptor "main" refers to so-called main event engine valve motions, i.e., valve motions used during positive power generation in which fuel is combusted in an engine cylinder to provide a net output of engine power, whereas the descriptor "auxiliary" refers to other engine valve motions for purposes that are alternative to positive power generation (e.g., compression release braking, bleeder braking, cylinder decompression, cylinder deactivation, brake gas recirculation (BGR), etc.) or in addition to positive power generation (e.g., internal exhaust gas recirculation (IEGR), variable valve actuations (VVA), early exhaust valve opening (EEVO), late intake valve closing (LIVC), swirl control, etc.).

In many internal combustion engines, the main and/or auxiliary motion sources may be provided by fixed profile cams, and more specifically by one or more fixed lobes or bumps which may be an integral part of each of the cams. Benefits such as increased performance, improved fuel economy, lower emissions, and better vehicle drivability may be obtained if the intake and/or exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide a "lost motion" or variable length device in the valve train linkage between a given engine valve and its corresponding cam. Lost motion is the term applied to a class of technical solutions for modifying the valve actuation motion defined by a cam profile with a variable length mechanical, hydraulic, or other linkage assembly. In a lost motion system, a cam lobe may provide the "maximum" motion (longest dwell and greatest lift) needed over a full range of engine operating conditions including, as required in some cases, for positive power generation operation and/or auxiliary operation. A variable length system may then be included in the valve train linkage, intermediate of the valve to be opened and the cam providing the maximum motion, to subtract or lose part or all of the motion imparted by the cam to the valve. Typically, such lost motion devices are controllable between a "locked" or motion conveying state and an "unlocked" or motion absorbing state. During the locked stated, the lost motion device is maintained in a substantially rigid configuration (with allowances for lash adjustments) such that valve actuation motions applied thereto are conveyed to the corresponding engine valve(s). On the other hand, during the unlocked state, the lost motion device is permitted to absorb or avoid, i.e., "lose," at least some (up to and including all) of the valve actuation motions applied thereto, thereby preventing such valve actuation motions from being conveyed to the corresponding engine valve(s).

Valve actuation systems incorporating lost motion capability continue to be developed to provide ever greater valve actuation functionality and flexibility. However, increased cost, packaging, and size are factors that may often determine the desirability of such engine valve actuation systems. Valve actuation systems comprising lost motions components that overcome these limitations while still providing varied valve actuation functionality and flexibility would represent a welcome advancement of the art.

SUMMARY

The instant disclosure describes various embodiments of a valve actuation system for actuating at least one engine valve in an internal combustion engine. In an embodiment, a system for actuating at least two engine valves associated with a cylinder of an internal combustion engine comprises a first rocker assembly operatively connected to a first valve actuation motion source and to a first engine valve of the at least two engine valves. The first rocker assembly comprises a first lost motion component arranged in series with a first input rocker and a first output rocker, where the first input rocker is configured to receive first valve actuation motions from the first valve actuation motion source and the first output rocker is configured to impart the first valve actuation motions to the first engine valve. The first lost motion component is operable, in a motion absorbing state, to prevent conveyance of the first valve actuation motions from the first input rocker to the first output rocker and, in a motion conveying state, to convey the first valve actuation motions from the first input rocker to the first output rocker. A second rocker assembly is operatively connected to a second valve actuation motion source and to a second engine valve of the at least two engine valves. The second rocker assembly comprises at least one second rocker configured to receive second valve actuation motions from the second valve actuation motion source and to impart the second valve actuation motions to the second engine valve. The system further comprises a one-way coupling mechanism disposed between the first output rocker and the at least one second rocker such that the second valve actuation motions are transferred from the at least one second rocker to the first output rocker, and the first valve actuation motions are not transferred from the first output rocker to the at least one second rocker.

In an embodiment, both or either of the first output rocker and/or the at least one second rocker comprises a hydraulic lash adjuster.

In an embodiment, the first rocker assembly is configured to operate as a Type II rocker or to operate as a Type III rocker.

In an embodiment, each of the first input rocker and the first output rocker comprises a shaft-mounted half rocker. Further to this embodiment, the first output rocker may comprise lateral arms defining a central opening configured to receiving the first input rocker between the lateral arms. In an alternative embodiment, the first output rocker and the first input rocker are configured to be deployed adjacent to each other.

In an embodiment, the at least one second rocker comprises a shaft-mounted half rocker.

In an embodiment, the one-way coupling mechanism comprises a coupling arm forming a part of the at least one second rocker and a coupling contact surface forming a part of the first output rocker, and wherein the coupling arm and coupling contact surface are configured to contact each other.

In an embodiment, the first lost motion component comprises a hydraulically controlled locking mechanism.

In another embodiment, the at least one second rocker comprises a second lost motion component arranged in series with a second input rocker and a second output rocker. The second input rocker is configured to receive the second valve actuation motions from the second valve actuation motion source and the second output rocker is configured to impart the second valve actuation motions to the second engine valve. The second lost motion component is operable, in a motion absorbing state, to prevent conveyance of the second valve actuation motions from the second input rocker to the second output rocker and, in a motion conveying state, to convey the second valve actuation motions from the second input rocker to the second output rocker.

In an embodiment, the second output rocker comprises a hydraulic lash adjuster.

In an embodiment, the second rocker assembly is configured to operate as a Type II rocker. Further to this embodiment, the first rocker assembly is also configured to operate as a Type II rocker.

In an embodiment, the second rocker assembly is configured to operate as a Type III rocker. Further to this embodiment, the first rocker assembly is also configured to operate as a Type III rocker.

In an embodiment, each of the second input rocker and the second output rocker comprises a shaft-mounted half rocker. Further to this embodiment, the second output rocker comprises lateral arms defining a central opening configured to receiving the second input rocker between the lateral arms. In an alternative embodiment, the second output rocker and the second input rocker are configured to be deployed adjacent to each other.

In an embodiment, the one-way coupling comprises a coupling arm forming a part of the second output rocker and a coupling contact surface forming a part of the first output rocker, and wherein the coupling arm and coupling contact surface are configured to contact each other.

In an embodiment, the second lost motion component comprises a hydraulically controlled locking mechanism.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, phrases substantially similar to "at least one of A, B or C" are intended to be interpreted in the disjunctive, i.e., to require A or B or C or any combination thereof unless stated or implied by context otherwise. Further, phrases substantially similar to "at least one of A, B and C" are intended to be interpreted in the conjunctive, i.e., to require at least one of A, at least one of B and at least one of C unless stated or implied by context otherwise. Further still, the term "substantially" or similar words requiring subjective comparison are intended to mean "within manufacturing tolerances" unless stated or implied by context otherwise.

As used herein, the term "operatively connected" is understood to refer to at least a functional relationship between two components, i.e., that the claimed components must be connected (potentially including the presence of intervening elements or components) in a way to perform an indicated function.

Figure 1:
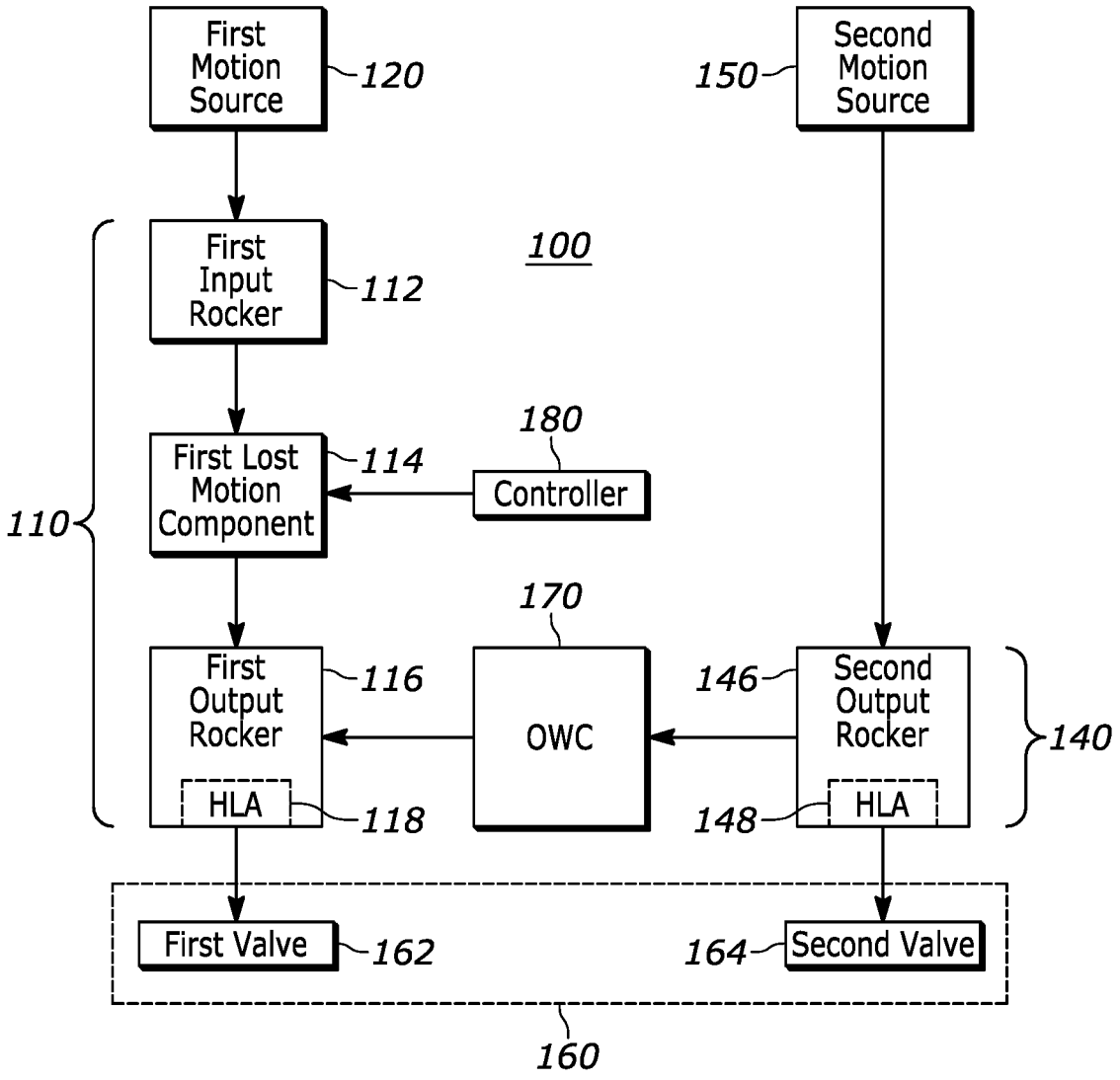
FIGS. 1 and 2 schematically illustrate embodiments of valve actuation systems, including a lost motion component, in accordance with the instant disclosure.

FIG. 1 schematically illustrates a first embodiment of a valve actuation system 100 comprising a first rocker assembly 110 and a second rocker assembly 140. As shown, the first rocker assembly 110 is operatively connected to a first valve actuation motion source 120 and the second rocker assembly 140 is operatively connected to a second valve actuation motion source 150. First and second engine valves 162, 164 (both of which may be, for example, intake valves or exhaust valves) are associated with a cylinder 160 of an internal combustion engine, which valves 162, 164 are operatively connected to respective ones of the first rocker assembly 110 and the second rocker assembly 140. In this manner, the first and second rocker assemblies 110, 140 operate to actuate (i.e., open and close) the engine valves 162, 164 as commanded by the first and second valve actuation motion sources 120, 150 (and subject to operation of any incorporated lost motion components) as described in further detail below. Although only a single cylinder 160 is illustrated in FIG. 1, it is appreciated that an internal combustion engine may comprise more than one cylinder and the valve actuation systems described herein may be applied to any number of cylinders for a given internal combustion engine.

The valve actuation motion sources 120, 150 may comprise any combination of elements capable of providing valve actuation motions, such as a cam. Each of the valve actuation motion sources 120, 150 may be dedicated to providing main exhaust motions, main intake motions, auxiliary motions or a combination of main exhaust or main intake motions together with auxiliary motions. For example, in one embodiment, the first motion source 120 is configured to provide auxiliary valve actuation motions and the second motion source 150 is configured to provide main valve actuation motions (either exhaust or intake).

In this first embodiment, the first rocker assembly 110 comprises a first input rocker 112, a first lost motion component 114 and a first output rocker 116 arranged in series. As used herein, the phrase "in series" is with reference to conveyance of valve actuation motions, i.e., components are in series at least to the extent that they convey valve actuation motions from one to the other along a path from a valve actuation motion source to one or more engine valves. In particular, the first input rocker 112 is operatively connected to the first valve actuation motion source 120 and the first output rocker 116 is operatively connected to the first engine valve 162, with the first lost motion component 114 operatively connected to and deployed between the first input and output rockers 112, 116. The first input and output rockers 112, 116 may comprise center pivoting or Type III rocker arms and various implementations based on center pivoting rocker arms are described in further detail below. It is appreciated, however, that the first input and output rockers 112, 116 may also be implemented using end pivoting or Type II rocker arms. Optionally (as indicated by the dashed lines), a first hydraulic lash adjuster (HLA) 118 may be included in the first rocker assembly 110. In the illustrated example, the first HLA 118 is deployed in the first output rocker 116, which may include hydraulic passages (as known in the art; not shown) suitable for providing hydraulic fluid to the first HLA 118. It is appreciated that the first HLA 118 may instead be deployed as part of the other components 112, 114 constituting the first rocker assembly 110.

As further depicted in FIG. 1, an engine controller 180 may be provided and operatively connected to the first lost motion component 114. The engine controller 180 may comprise any electronic, mechanical, hydraulic, electrohydraulic, or other type of control device for controlling operation of the first lost motion mechanism 114, i.e., switching between its respective locked and unlocked states as described above. For example, the engine controller 180 may be implemented by a microprocessor and corresponding memory storing executable instructions used to implement the required control functions, including those described below, as known in the art. It is appreciated that other functionally equivalent implementations of the engine controller 180, e.g., a suitably programmed application specific integrated circuit (ASIC) or the like, may be equally employed. Further, the engine controller 180 may include peripheral devices, intermediate to engine controller 180 and the first lost motion component 114, that allow the engine controller 180 to effectuate control over the operating state of the first lost motion device 114. For example, where the first lost motion device 114 is a hydraulically controlled mechanism (i.e., responsive to the absence or application of hydraulic fluid to an input), such peripheral devices may include suitable solenoids.

As shown in FIG. 1, control of the first lost motion component 114 by the engine controller 180 is provided directly to the first lost motion component 114. In practice, however, such control may be provided via a path through at least one of the adjoining input or output rockers 112, 116. For example, in the various embodiments described herein, such control is provided through the use of hydraulic fluid supplied via one or more fluid passages formed in the first input or output rocker 112, 116 under the control of the engine controller 180. However, as will be appreciated by those having skill in the art, other types of control schemes may be equally employed for this purpose.

As further shown in FIG. 1, the second rocker assembly 140 comprises a second rocker 146 operatively connected to the second valve actuation motion source 150 and to the second engine valve 164. Once again, a second, optional HLA 148 may be included in the second rocker assembly 140. In the illustrated example, the second HLA 148 is deployed in the second rocker 146, which may include hydraulic passages (not shown) suitable for providing hydraulic fluid to the second HLA 148. Note that, because the second rocker assembly 140 does not include a lost motion component, it may not be necessary to ensure the controlled operation (i.e., stroke limiting) as described above relative to the first HLA 118.

A feature of the illustrated first embodiment is the provision of a one-way coupling (OWC) 170 between the second rocker 146 of the second rocker assembly 140 and the first output rocker 116 of the first rocker assembly 110. The second rocker 146 is capable of driving the first output rocker 116, but not vice versa, as indicated by the unidirectional arrows shown in FIG. 1 between the second rocker 146, the one-way coupling 170 and the first output rocker 116. That is, the presence of the one-way coupling 170 permits valve actuations provided by the second valve actuation motion source 150 to be applied to the first output rocker 116, whereas valve actuations provided by the first valve actuation motion source 120 cannot be applied to the second rocker 146. In an embodiment, the one-way coupling 170 is implemented using fixed elements such that the one-way coupling 170 is "always there," i.e., the one-way coupling 170 is not selectable. However, it is appreciated that the one-way coupling 170 could also be implemented using selectable elements, such as a hydraulically controlled actuator.

Configured as shown in FIG. 1, the valve actuation system 100 provides various options for actuating the engine valves 162, 164. For example, where the second valve actuation motion source 150 provides main valve actuation motions and the first valve actuation motion source 120 provides auxiliary valve actuation motions, the first lost motion component 114 can be controlled to be in its unlocked or motion absorbing state such that auxiliary valve actuation motions applied to the first input rocker 112 are not conveyed by the first lost motion component 114 to the first output rocker 116 or, consequently, the first engine valve 162. In this case, the main valve actuation motions applied to the second rocker 146 are applied to the second engine valve 164. Additionally, by virtue of the one-way coupling 170, the main valve actuation motions applied to the second rocker 146 are also applied to the first output rocker 116 and, thereby, to the first engine valve 162. Such control of the engine valves 162, 164 can be used, for example, to implement positive power generation operation of the engine.

On the other hand, the first lost motion component 114 can be controlled to be in its locked or motion conveying state such that auxiliary valve actuation motions applied to the first input rocker 112 are conveyed by the first lost motion component 114 to the first output rocker 116 and, thereby, the first engine valve 162. In this case, the second rocker 146 and one-way coupling 170 would continue to operate as described above, with the result that the main valve actuation motions would be provided to both the first and second engine valves 162, 164 whereas the auxiliary valve actuation motions would be provided to only the first engine valve 162. Such control of the engine valves 162, 164 can be used to implement, for example, conventional 4-stroke, compression-release engine braking operation of the engine, or to provide other, additive auxiliary valve actuation motions of the types noted above.

Figure 2:
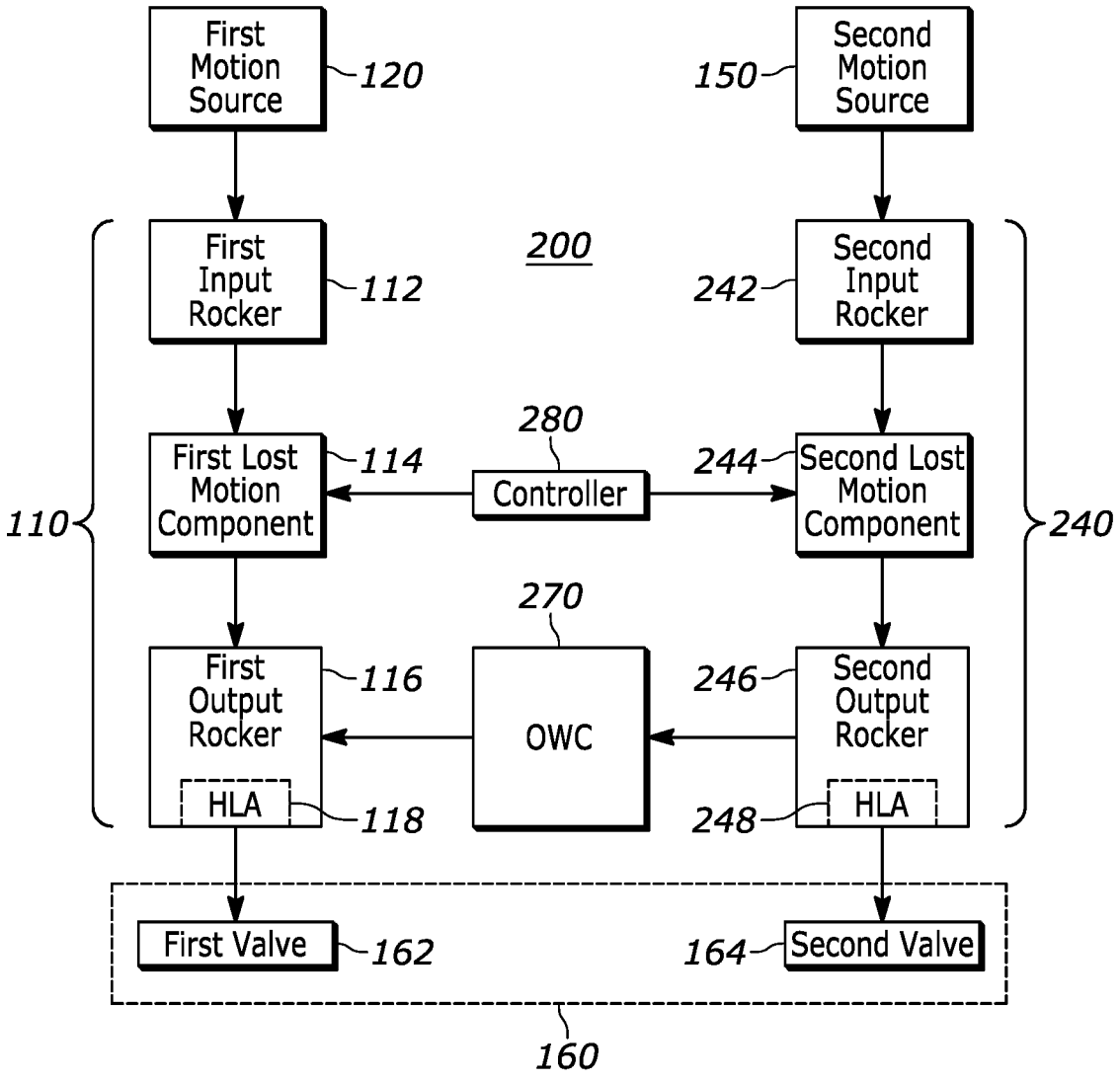

Referring now to FIG. 2, a second embodiment of a valve actuation system 200 comprising a first rocker assembly 110 and a second rocker assembly 240 is shown. The valve actuation system 200 of FIG. 2 primarily differs from the valve actuation system 100 of FIG. 1 in the constituent elements forming the second rocker assembly 240 of FIG. 2. More specifically, the second rocker assembly 240 comprises a second input rocker 242, a second lost motion component 244 and a second output rocker 246 arranged in series. In particular, the second input rocker 242 is operatively connected to the second valve actuation motion source 150 and the second output rocker 246 is operatively connected to the second engine valve 162, with the lost motion component 244 operatively connected to and deployed between the second input and output rockers 242, 246. The second input and output rockers 242, 246 may comprise center pivoting rocker arms and various implementations based on center pivoting rocker arms are described in further detail below. It is appreciated, once again, that the first input and output rockers 112, 116 may also be implemented using end pivoting or Type II rocker arms. Optionally, a second hydraulic lash adjuster (HLA) 248 may be included in the second rocker assembly 240. In the illustrated example, the second HLA 248 is deployed in the second output rocker 246, which may include hydraulic passages (not shown) suitable for providing hydraulic fluid to the second HLA 248. It is appreciated that the second HLA 248 may instead be deployed as part of the other components 242, 244 constituting the second rocker assembly 110. As with the first HLA 118 in the first embodiment, it may be desirable to control operation of the second HLA 248 to prevent overextension of second engine valve 164 given the presence of the second lost motion component 244 in the second rocker assembly 240. Alternatively, once again, prevention of engine valve overextension through operation of the HLA 248 may instead be provided, in this case, by stroke limiting incorporated into the second lost motion component 244 as well as a bias force supplied by the first lost motion component 224 sufficient to prevent overexpansion of the HLA 248.

Given the addition of the second lost motion component 244 to the second rocker assembly 240, the controller 280 in the second embodiment is substantially identical to the controller 180 in the first embodiment with the exception that the controller 280 is modified to also be operatively coupled to the second lost motion component 244. Once again, though the controller 280 is illustrated as directly controlling the second lost motion component 244, it will be appreciated that such control may be mediated through paths provided in adjacent components, e.g., the second input rocker 242 and/or the second output rocker 246.

Further still, the operation of the one-way coupling 270 of the second embodiments is substantially identical to the operation of the one-way coupling 170 of the first embodiment, with the exception that the one-way coupling 270 is deployed between the second output rocker 246 and the first output rocker 116 as shown in FIG. 2.

Configured as shown in FIG. 2, the valve actuation system 100 provides various options for actuating the engine valves 162, 164. For example, once again, where the second valve actuation motion source 150 provides main valve actuation motions and the first valve actuation motion source 120 provides auxiliary valve actuation motions, the first lost motion component 114 can be controlled to be in its unlocked or motion absorbing state such that auxiliary valve actuation motions applied to the first input rocker 112 are not conveyed by the first lost motion component 114 to the first output rocker 116 or, consequently, the first engine valve 162. Additionally, the second lost motion component 244 can be controlled to also be in its unlocked or motion absorbing state such that main valve actuation motions applied to the second input rocker 242 are not conveyed by the second lost motion component 244 to the second output rocker 246 or, consequently, the second engine valve 164 (or first engine valve by virtue of the one-way coupling 270). Such control of the engine valves 162, 164 can be used, for example, to implement cylinder deactivation (CDA) operation of the engine.

Alternatively, based on this same example, where the first lost motion component 114 is once again operated in its unlocked/motion absorbing state and the second lost motion component 244 is operated in its locked/motion conveying state, the auxiliary valve actuation motions will not be conveyed to the first engine valve 162 whereas the main valve actuation motions will be conveyed to both the first and second valves 162, 164. Such control of the engine valves 162, 164 can be used, for example, to implement positive power generation operation of the engine.

In another alternative, based on this same example, where the first lost motion component 114 is operated in its locked/motion conveying state and the second lost motion component 244 is operated in its locked/motion conveying state, the auxiliary valve actuation motions will be conveyed to the first engine valve 162 and the main valve actuation motions will be conveyed to both the first and second valves 162, 164. Such control of the engine valves 162, 164 can be used to implement, for example, conventional 4-stroke, compression-release engine braking operation of the engine, or to provide other, additive auxiliary valve actuation motions of the types noted above.

In yet another alternative, based on this same example, where the first lost motion component 114 is operated in its locked/motion conveying state and the second lost motion component 244 is operated in its unlocked/motion absorbing state, the auxiliary valve actuation motions will be conveyed to the first engine valve 162 whereas the main valve actuation motions will not be conveyed to either the first or second valves 162, 164. Such control of the engine valves 162, 164 can be used to implement operating modes in which auxiliary valve actuations, but not main valve actuations are desired. For example, such operating modes may include so-called 2-stroke or 1.5-stroke, compression-release engine braking operation of the engine.

Figure 3:
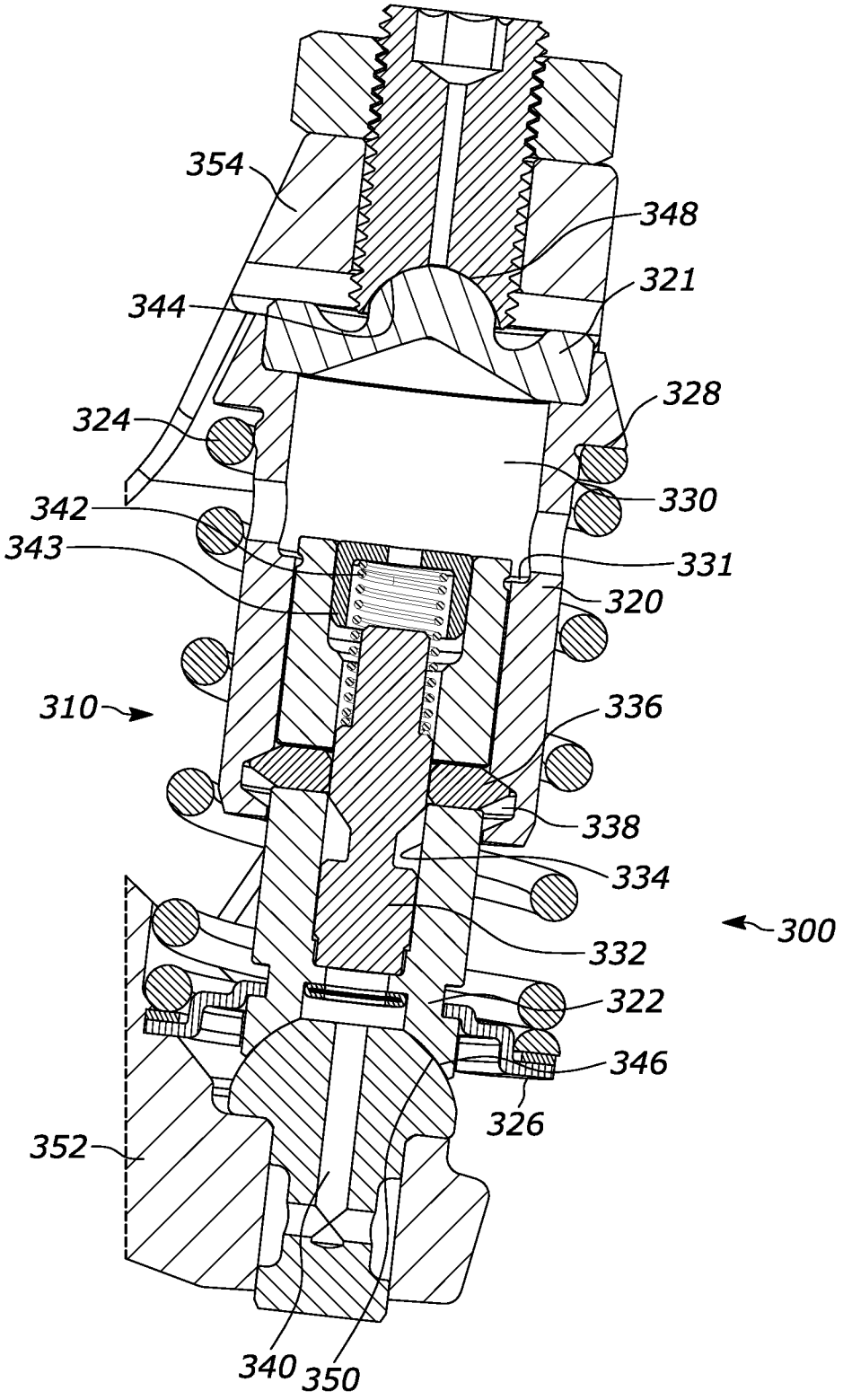
FIG. 3 is a cross-sectional illustration of an example of a lost motion component that may be used to implement the various embodiments described herein.

FIG. 3 illustrates an example of a lost motion component 300 that may be used in conjunction with the valve actuation systems 100, 200 illustrated in FIGS. 1 and 2, as well as the various specific implementations described below relative to FIGS. 4-11. The lost motion component 300 is depicted in cross section, thereby better illustrating a hydraulically controlled locking mechanism 310, constituting a subassembly of the lost motion component 300 and deployed between a housing 320 and a plunger 322. Although the housing 320 may be formed as a unitary element, in the example illustrated in FIG. 3, a closed end of the housing 320 is provided by an end cap 321 attached to the housing 320. A plunger spring 324 is deployed outside of the housing 320 and plunger 322. In the illustrated embodiment, the plunger spring 324 is deployed between a flange 326 formed on or attached to an outer surface of the plunger 322 and a shoulder 328 formed in the housing 320. In this manner, the plunger spring 324 biases the housing 320 and plunger 322 away from each other. In an embodiment, the bias force applied by the plunger spring 324 is sufficiently high so as to prevent extension of any hydraulic lash adjuster deployed within the same valve train as the lost motion component 300. Further still, while the plunger spring 324 is deployed in the illustrated example as being outside of the housing 320, it is appreciated that the plunger spring 324 could also be disposed within the housing 320 such that it provides similar biasing as described above.

As noted, the plunger spring 324 is sufficiently strong as to prevent extension of any hydraulic lash adjusters deployed in the same valve train as the lot motion component 300. However, this could lead to collapse of the hydraulic lash adjuster if the bias force of the plunger spring 324 is too strong. To prevent this, stroke limiting may be provided in the lost motion component 300 so as to prevent overextension of the housing 320 and plunger 322 away from each other, which could otherwise place a compressive force on a hydraulic lash adjuster sufficient to cause the hydraulic lash adjuster to collapse. For example, though not shown in FIG. 3, an end of the plunger 322 in proximity to the plunger cap 343 could include a radially extending lip or flange that is configured to engage a shoulder 331 formed in a surface defining the housing bore 330. Thus, when the plunger 322 is biased out of the housing 320 by the plunger spring 324, engagement of the radially extending lip or flange with the shoulder 331 prevents further travel of the plunger 322 out of the housing 320. By traveling limiting the plunger 322, the lost motion component 300 is prevented from applying excessive compressive force on any constituent hydraulic lash adjuster in the valve train, thereby prevent collapse of the hydraulic lash adjuster.

As shown in FIG. 3, the locking mechanism 310 includes the plunger 322 disposed within a housing bore 330 formed in and extending along a longitudinal axis of the lost motion component 300 from a first end of the housing 320. An inner plunger 332 is slidably disposed in a longitudinal bore 334 formed in the plunger 322. An inner plunger spring 342 is provided between the inner plunger 332 and a plunger cap 343, thereby tending to bias the inner plunger out of the bore 334. Locking elements in the form of wedges 336 are provided, which wedges are configured to engage with an annular outer recess 338 formed in a surface defining the housing bore 330. The illustrated embodiment is of a normally locked locking mechanism 310, i.e., in the absence of hydraulic control applied to the inner plunger 332 via, in this case, a lost motion hydraulic passage 340, the inner plunger spring 342 biases the inner plunger 332 into position such that the wedges 336 radially extend out of openings formed in the plunger 320, thereby engaging the outer recess 338 and effectively locking the plunger 322 in place relative to the housing 320.

In this locked state, any valve actuation motions (whether main or auxiliary motions) applied to either end of the lost motion component 300 are conveyed by the lost motion component 300. It is noted that, despite being in the locked state as shown in FIG. 3, a longitudinal extent of the outer recess 338 is greater than a thickness of the wedges 336 such that a small amount of movement is nevertheless permitted between the plunger 322 and housing 320. Such additional space provided by the outer recess 338 facilitates locking/unlocking of the locking mechanism 310 when the lost motion component 300 is unloaded. As shown in FIG. 3, this additional space has been taken up as in the case, for example, where a valve actuation motion has been applied to the lost motion component 300 thereby overcoming any outward bias applied by the plunger spring 324 to the plunger 322.

The bias applied by the plunger spring 324 can be selected to additionally ensure that the adjacent valve train components 352, 354 (or such additional up- or downstream valve train components in the system, not shown) are biased into continuous contact with respective endpoints of the valve train, i.e., valve actuation motions sources and engine valves. For example, as described in further detail below, input and output rockers are provided within rocker assemblies in series with a lost motion component. In this case, the plunger spring 324 of the lost motion component can apply biasing forces to the input and output rockers to ensure that such input rockers are biased into contact with valve actuation motion sources and/or that such output rockers are biased toward respective engine valves, thereby sufficiently loading any constituent hydraulic lash adjusters in order to prevent overexpansion thereof.

Referring again to FIG. 3, provision of hydraulic fluid to the input-receiving end (bottommost surface as shown in FIG. 3) of the inner plunger 332 via the lost motion hydraulic passage 340, sufficiently pressurized to overcome the bias of the inner plunger spring 342, causes the inner plunger 332 to translate within the bore 334 such that the wedges 336 are permitted to retract and disengage from the outer recess 338, thereby effectively unlocking the plunger 322 relative to the housing 320 and permitting the plunger 322 to slide freely within its bore 330, subject, in this case, to the bias provided by the plunger spring 324. In this unlocked state, any valve actuation motions applied to the lost motion component 300 will cause the plunger 322 to reciprocate in its bore 330. In this manner, and presuming travel of the plunger 322 within its bore 330 is greater than the maximum extent of any applied valve actuation motions (i.e., that the plunger 322 is unable to bottom out in its bore 330), such valve actuation motions are not conveyed by the lost motion component 300 and are effectively lost. Alternatively, travel of the plunger 322 within its bore 330 could be configured such that the plunger 322 "bottoms out," i.e., makes contact with the closed end of the bore 330, so as to always provide a "failsafe" valve lift in the event of a failure of the locking mechanism 310.

Although FIG. 3 illustrates a particular embodiment and configuration of a lost motion component 300, it is understood that other configurations may be equally employed and the instant disclosure is not limited in this regard. For example, as noted previously, the illustrated lost motion component 300 is a normally locked lost motion component. However, as will be appreciated by those skilled in the art, normally unlocked types of lost motion components may be equally employed.

Figure 3A:
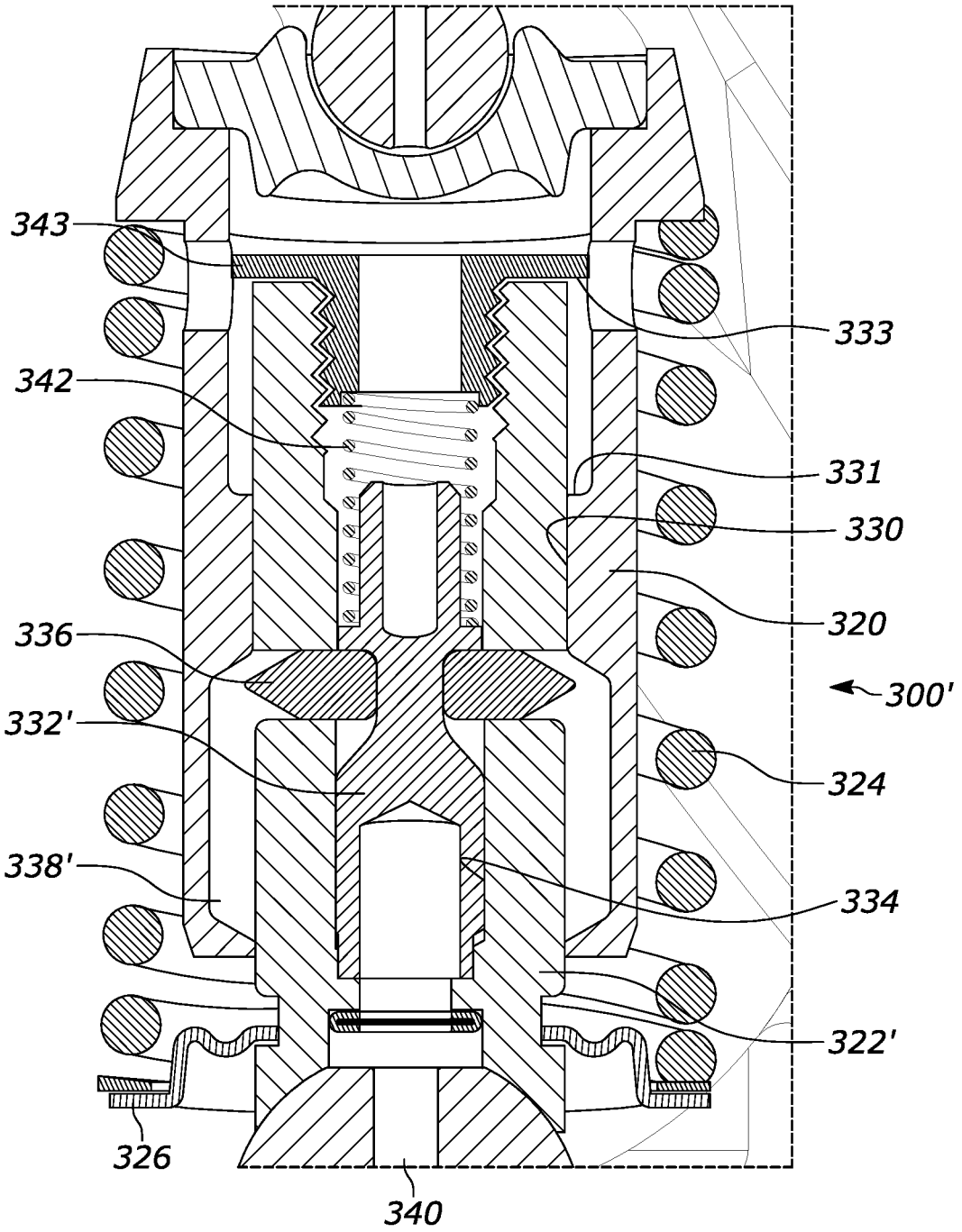
FIG. 3A is a cross-sectional illustration of an alternative example of a lost motion component that may be used to implement the various embodiments described herein.

FIG. 3A illustrates an example of a normally unlocked lost motion component 300'. Elements having like reference numerals in FIGS. 3 and 3A are substantially similar in structure and function, whereas reference numerals including a prime symbol (') in FIG. 3A refer to elements that are characterized by differing structure and/or function relative to counterparts illustrated in FIG. 3, as described below. In the embodiment illustrated in FIG. 3A, the lost motion component 300' once again includes a housing 320 having a longitudinal bore 330 formed therein, and a plunger 322' slidably disposed in the bore 330. Likewise, an inner plunger 332' is disposed in a bore 334' formed in the plunger 322' and biased out of the bore 334' by an inner plunger spring 342 disposed between the inner plunger 332' and a plunger cap 343.

However, in this case, the inner plunger 332' is structured essentially opposite the inner plunger 332 shown in FIG. 3 such that, in the absence of hydraulic control applied to the inner plunger 332', the inner plunger spring 342 biases the inner plunger 332' into position such that the wedges 336 do not radially extend out of openings formed in the plunger 320 and therefore do not engage the outer annular recess 338', thereby effectively unlocking the plunger 322' relative to the housing 320 and permitting the plunger 322' to slide freely within its bore 330, subject to the bias provided by the plunger spring 324. In this unlocked state, any valve actuation motions applied to the lost motion component 300' will cause the plunger 322' to reciprocate in its bore 330. In the illustrated embodiment, the plunger 322' is configured such that travel of the plunger 322' within its bore 330 permits the plunger 322' to "bottom out," i.e., to make contact, in this case, between the plunger cap 343 and the closed end of the bore 330. In this manner, the lost motion component 300' is able to prevent overextension of any hydraulic lash adjuster disposed in the same valve train as the lost motion component 300'. Additionally, such travel limiting of the plunger 322' permits application of a "failsafe" auxiliary valve actuation motion, e.g., a high-lift braking gas recirculation (BGR) motion, in the event of failure of the locking mechanism 310. Once again, stroke limiting may be provided in the lost motion component 300' so as to prevent overextension of the housing 320 and plunger 322' away from each other, which could otherwise cause collapse of a hydraulic lash adjuster. For example, as shown in FIG. 3A, the plunger cap 343 may be configured such that it includes a radially extending lip or flange 333 configured to engage the shoulder 331 formed in the bore 330, thereby preventing overextension of the plunger 322' out of the bore 330.

On the other hand, provision of hydraulic fluid to the input-received end (bottommost surface as shown in FIG. 3A) of the inner plunger 332' sufficiently pressurized to overcome the bias of the inner piston spring 342, causes the inner plunger 332' to translate within the bore 334 such that the wedges 336 are forced to extend and engage with the outer recess 338', thereby effectively locking the plunger 322' relative to the housing 320. In this locked state, valve actuation motions applied to the lost motion component 300' will cause the plunger 322' to engage the housing 320 thereby transmitting such valve actuation motions.

A further feature of the housing 320 is that the annular outer recess 338' has a longitudinal extent such that the plunger 322' is permitted to slide within its bore 330 even when the lost motion component 300' is in its locked/motion conveying state. As described in further detail below, this configuration of the outer recess 338' accommodates separation between the first input and output rockers 112, 116 during operating states in which the first output rocker 116 is controlled by the second rocker 146/second output rocker 246 and the intervening one-way coupling 170, 270.

Figure 4:
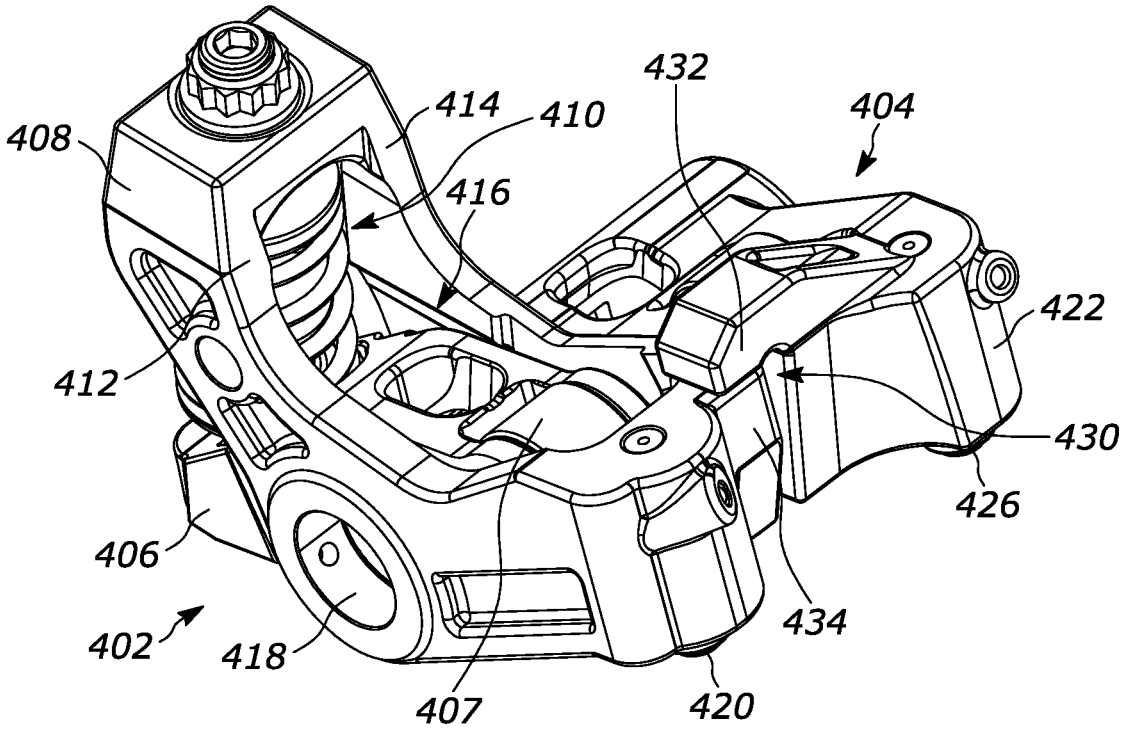
FIGS. 4-6 illustrate a first implementation of a valve actuation system in accordance with the first embodiment of FIG. 1.
Figure 5:
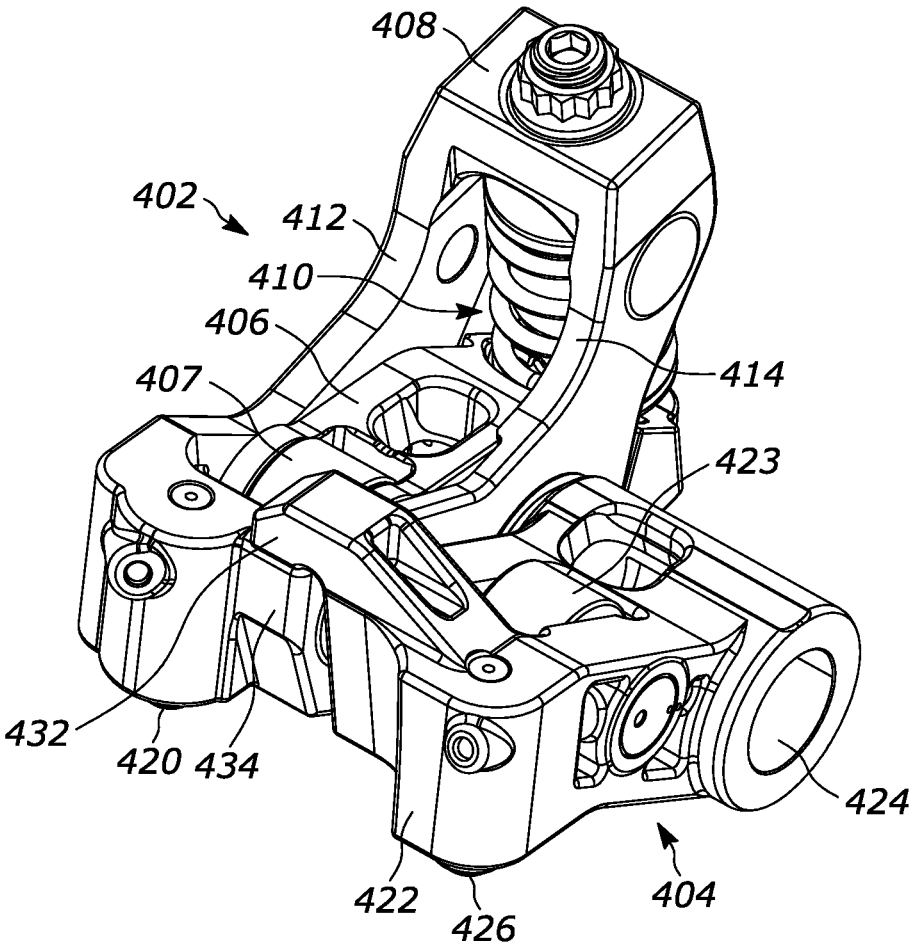
Figure 6:
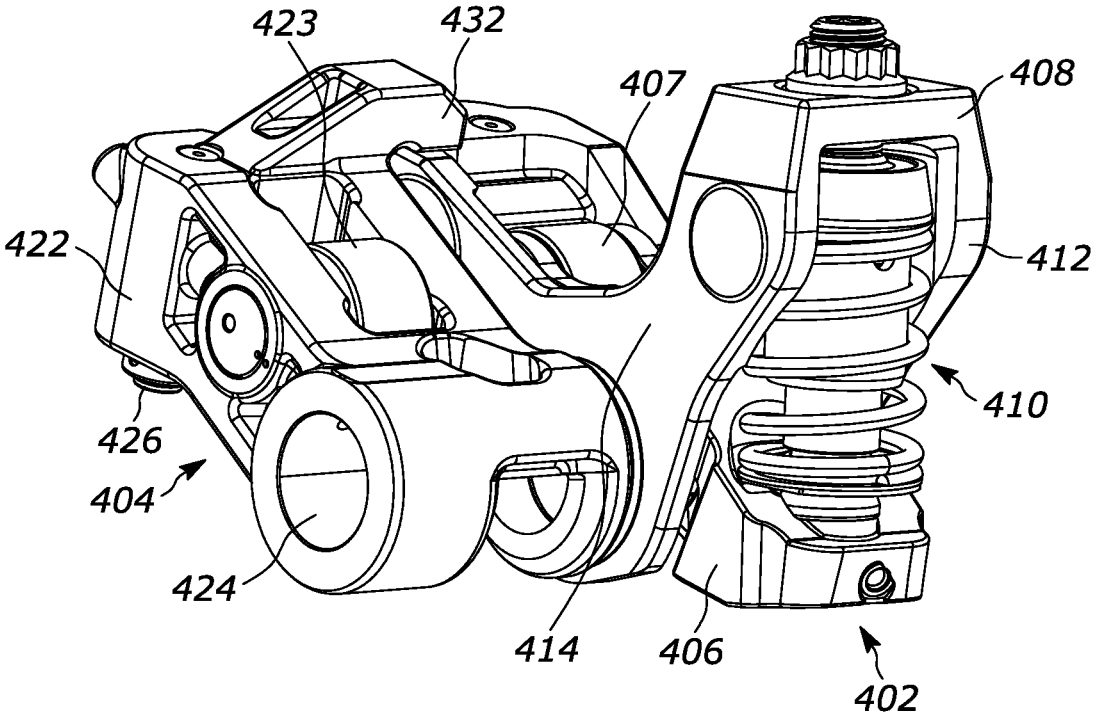

Referring now to FIGS. 4-6, a first implementation of a valve actuation system in accordance with the first embodiment of FIG. 1 is shown. In particular, the embodiment shown includes a first rocker assembly 402 and a second rocker assembly 404. The first rocker assembly 402 comprises a first input rocker 406, a first output rocker 408 and a lost motion component 410. The first input rocker 406 comprises a roller bearing 407 configured to receive valve actuation motions from a first valve actuation motion source, e.g., a cam disposed on an overhead camshaft (not shown), at a motion receiving end of the first input rocker 406. The first input rocker 406 is, at a motion imparting end thereof, operatively connected to an input end of the first lost motion component 410. In turn, the first lost motion component 410 is operatively connected, at an output end thereof, to a motion receiving end of the first output rocker 408. In an embodiment, the first input rocker 406 may include one or more hydraulic passages (not shown) configured to receive hydraulic fluid from, for example, a rocker shaft (not shown) and route such hydraulic fluid to the first lost motion component 410 (thereby controlling operation thereof as described above relative to FIG. 3).

The first output rocker 408 comprises, in this embodiment, a pair of lateral arms 412, 414 that define a central opening 416 therebetween, which central opening 416 is configured to receive the first input rocker 406, thereby encompassing or embracing the first input rocker 406 between the lateral arms 412, 414. The first output rocker 408 also comprises, in this embodiment, a hydraulic lash adjuster 420 configured to be operatively connected to a first engine valve (not shown). The first output rocker 408 also comprises one or more internal hydraulic passages (not shown) configured to receive hydraulic fluid from, for example, a rocker shaft (not shown) and route such hydraulic fluid to the hydraulic lash adjuster 420 in accordance with known techniques.

As best shown in FIG. 4, the first output rocker 408 includes a rocker shaft bore 418 formed in both of the lateral arms 412, 414 configured to receive the rocker shaft. Additionally, although not shown in FIGS. 4-6, the first input rocker 406 also includes a rocker shaft bore configured to receive the rocker shaft. Configured in this manner, both the first input and output rockers 406, 408 are able to reciprocate about the rocker shaft in response to valve actuation motions applied to the first input rocker 406 (and, via the first lost motion component 410, to the output rocker 408) or, as explained in further detail below, in response to valve actuation motions applied to the first output rocker 408 via the second rocker assembly 404.

It is noted that, from the point of view of the first valve actuation motion source (applying valve actuation motions to the first input rocker 406) and the first engine valve (receiving valve actuation motions from the first output rocker 408), the first rocker assembly 402 operates like a Type II or end pivot rocker arm, akin to so called finger followers as known in the art. However, to achieve such operation the first rocker assembly 402 relies on the combination of two Type III or center pivot rocker arms (the first input and output rockers 406, 408) in conjunction with the first lost motion assembly 410. That is, the first rocker assembly 402 may be thought of as a quasi- or compound-Type II rocker based on a combination of constituent Type III rockers.

The second rocker assembly 404, in this embodiment, comprises a second rocker 422. As best shown in FIGS. 5 and 6, the second rocker 422 is, in this embodiment, a shaft-mounted, end pivoting or Type II rocker comprising a rocker shaft bore 424 configured to receive the rocker shaft. As illustrated, the second rocker assembly 404 resides adjacent to the first rocker assembly 402 and, more particularly, the second rocker 422 is disposed on the rocker shaft adjacent to the first output rocker 408. The second rocker 422 also comprises a roller bearing 423 configured to receive valve actuation motions from a second valve actuation motion source, e.g., a cam disposed on the overhead camshaft. The second rocker 422 also comprises, in this embodiment, a hydraulic lash adjuster 426 configured to be operatively connected to a second engine valve (not shown). As with the first output rocker 408, the second rocker 422 also comprises one or more internal hydraulic passages (not shown) configured to receive hydraulic fluid from, for example, the rocker shaft and route such hydraulic fluid to the hydraulic lash adjuster 426 in accordance with known techniques. Configured in this manner, the second rocker 422 is able to reciprocate about the rocker shaft in response to valve actuation motions applied by the second valve actuation motion source and convey such valve actuation motions to the second engine valve.

As best shown in FIGS. 4 and 5, a one way coupling 430 is provided between the second rocker arm 422 and the first output rocker 408. In this embodiment, the one way coupling 430 is formed by the combination of a coupling arm 432 and a coupling contact surface 434 respectively disposed at motion imparting ends of the second rocker 422 and the first output rocker 408. The coupling arm 432 is integrally formed in the second rocker 422 and extends toward the first output rocker 408. The upward-facing coupling contact surface 434 is integral to the first output rocker 408 and aligned so as to establish contact with (but not lock with or fasten to) a downward-facing surface of the coupling arm 432. In this manner, valve actuation motions applied to the second rocker 422 are conveyed to the first output rocker 408, whereas valve actuation motions applied to the first output rocker 408 via the first input rocker 406 and first lost motion component 410 are not conveyed to the second rocker 422. Although, in the illustrated embodiment, the constituent elements of the one way coupling 430 are disposed on motion imparting ends of the second rocker 422 and the first output rocker 408, it is appreciated that the one way coupling 430 may be disposed at various locations between the respective rockers. Additionally, although the contact surfaces provided by the coupling arm 432 and coupling contact surface 434 are illustrated as fixed surfaces, it is appreciated that such surfaces could be made to be selectable, as in the case of adjustable lash screws or the like. Further still, it is appreciated that the one way coupling 430 may be constructed using two coupling arms that extend toward each other with overlapping contact surfaces, as may be necessary where the first and second rocker assemblies 402, 404 are not positioned immediately adjacent each other.

Figure 7:
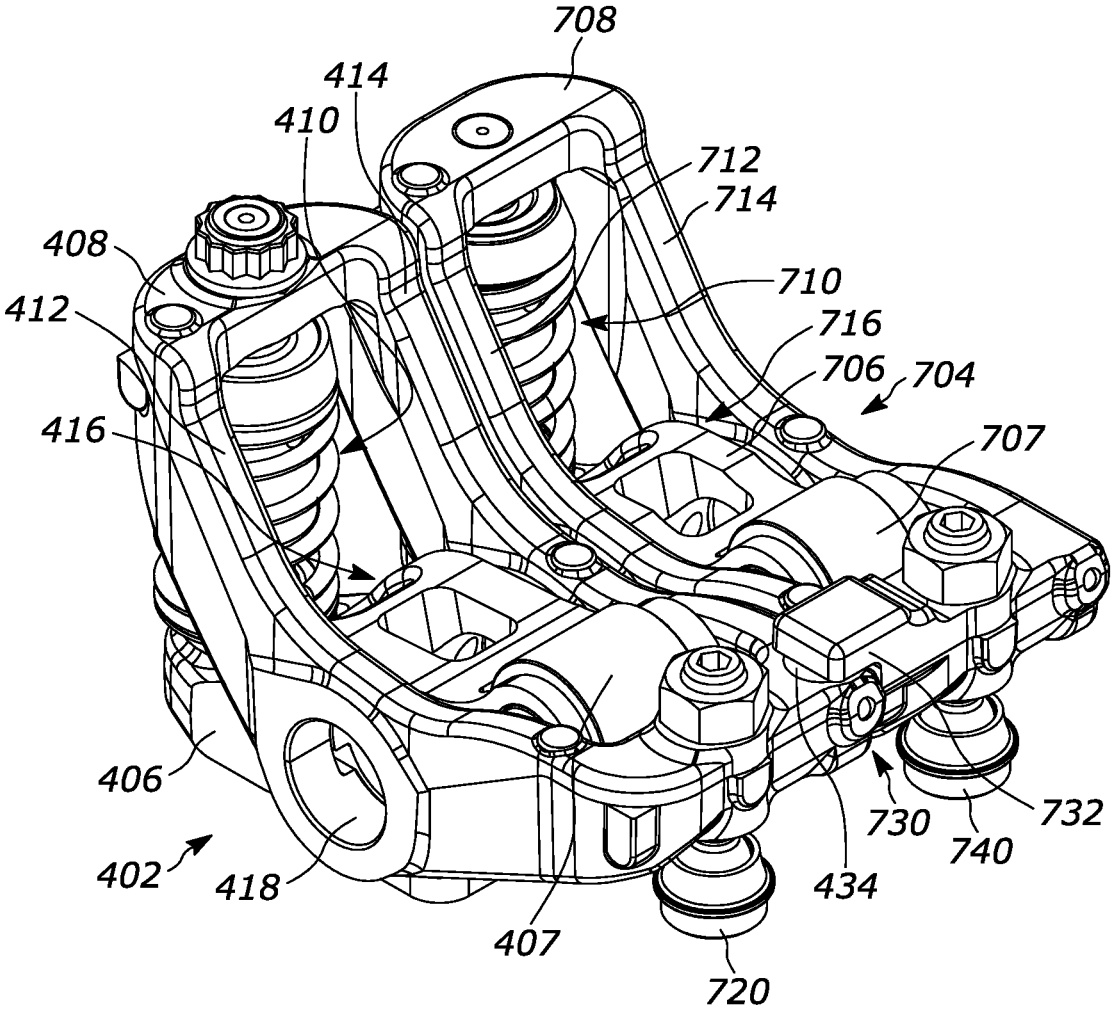
FIGS. 7 and 8 illustrate a second implementation of a valve actuation system in accordance with the second embodiment of FIG. 2.
Figure 8:
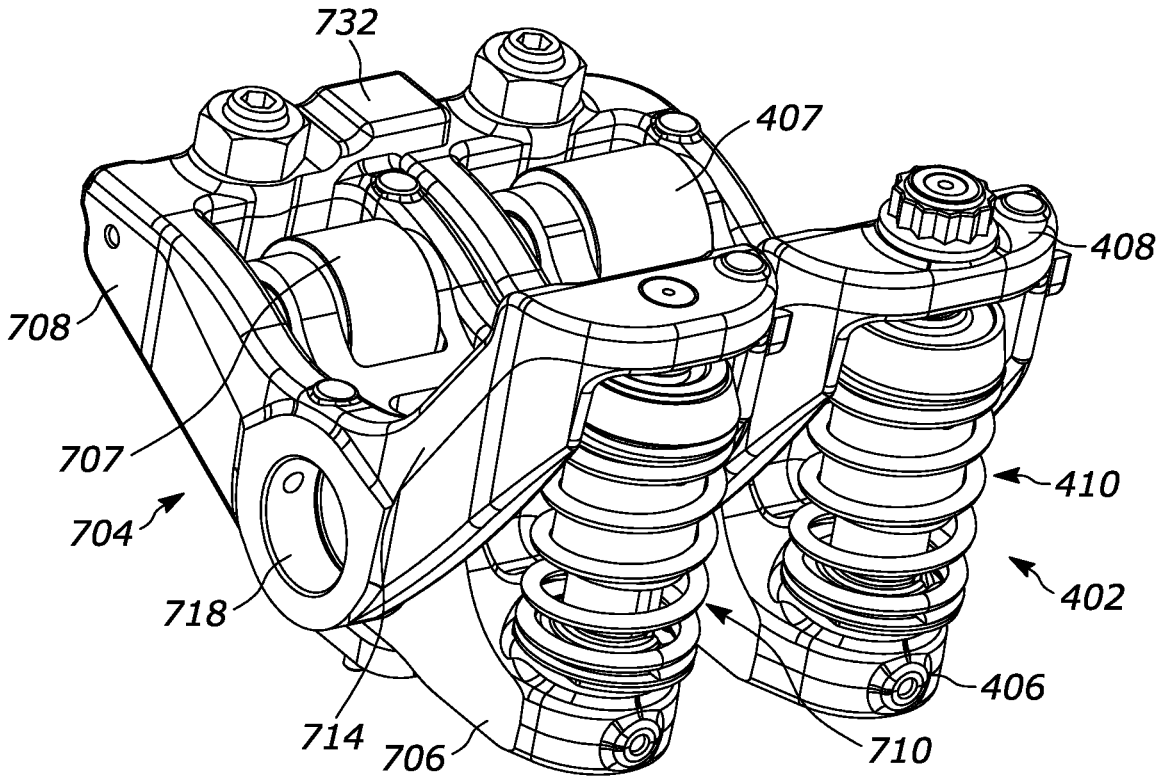

Referring now to FIGS. 7 and 8, a second implementation of a valve actuation system in accordance with the second embodiment of FIG. 2 is shown. In keeping with FIG. 2, the implementation shown in FIGS. 7 and 8 includes a first rocker assembly 402 and an adjacent second rocker assembly 704. The first rocker assembly 402 illustrated in FIGS. 7 and 8 is essentially identical in function and construction to the first rocker assembly 402 illustrated in FIGS. 4-6, as indicated by the like reference numerals. However, in keeping with embodiment of FIG. 2, the second rocker assembly 704 is more complex than the second rocker assembly 404 illustrated in FIGS. 4-6. In this case, the second rocker assembly 704 comprises a second input rocker 706, a second output rocker 708 and a second lost motion component 710. The second input rocker 706 comprises a roller bearing 707 configured to receive valve actuation motions from a second valve actuation motion source, e.g., a cam disposed on an overhead camshaft (not shown), at a motion receiving end of the second input rocker 706. The second input rocker 706 is, at a motion imparting end thereof, operatively connected to an input end of the second lost motion component 710. In turn, the second lost motion component 710 is operatively connected, at an output end thereof, to a motion receiving end of the second output rocker 708. In an embodiment, the second input rocker 706 may include one or more hydraulic passages (not shown) configured to receive hydraulic fluid from, for example, a rocker shaft (not shown) and route such hydraulic fluid to the second lost motion component 710 (thereby controlling operation thereof as described above relative to FIG. 3). The second output rocker 708 comprises, substantially identical to the first output rocker 408, a pair of lateral arms 712, 714 that define a central opening 716 therebetween, which central opening 716 is configured to receive the second input rocker 706, thereby encompassing or embracing the second input rocker 706 between the lateral arms 712, 714.

Unlike the implementation of FIGS. 4-6, the first and second output rockers 408, 708 each comprises a lash screw and swivel (or e-foot) assembly 720, 740 disposed on motion imparting ends of the first and second output rockers 408, 708, rather than hydraulic lash adjusters. Nonetheless, it is understood that respective hydraulic lash adjusters could be used in place of one or both of the lash screw and swivel assemblies 720, 740, provided that either or both of the first and second output rockers 408, 708 are configured to include the necessary hydraulic passages needed to operate the hydraulic lash adjuster(s).

As best shown in FIG. 8, the second output rocker 708 includes a rocker shaft bore 718 formed in both of the lateral arms 712, 714 configured to receive the rocker shaft. Additionally, although not shown in FIGS. 7 and 8, the second input rocker 706 also includes a rocker shaft bore configured to receive the rocker shaft. Configured in this manner, both the first input and output rockers 706, 708 are able to reciprocate about the rocker shaft in response to valve actuation motions applied to the first input rocker 406 (and, via the first lost motion component 410, to the first output rocker 408) or, in response to valve actuation motions applied to the first output rocker 408 via the second rocker assembly 704 and one way coupling 730.

As with the implementation shown in FIGS. 4-6, the second rocker assembly 704 resides adjacent to the first rocker assembly 402 and, more particularly, the second output rocker 708 is disposed on the rocker shaft adjacent to the first output rocker 408. The second input rocker 706 also comprises a roller bearing 707 configured to receive valve actuation motions from a second valve actuation motion source, e.g., a cam disposed on the overhead camshaft. Configured in this manner, the second input rocker 706 and (in conjunction with the second lost motion component 710) the second output rocker 708 are able to reciprocate about the rocker shaft in response to valve actuation motions applied by the second valve actuation motion source to the second input rocker 706.

As best shown in FIG. 7, a one way coupling 730 is provided between the second output rocker 708 and the first output rocker 408. In this embodiment, the one way coupling 730 is formed by the combination of a coupling arm 732 and the above-described coupling contact surface 434 respectively disposed at motion imparting ends of the second output rocker 708 and the first output rocker 408. In this case, the coupling arm 732 is integrally formed in the second output rocker 708 and extends toward the first output rocker 408. Once again, the upward-facing coupling contact surface 434 is integral to the first output rocker 434 and aligned so as to establish contact with (but not lock with or fasten to) a downward-facing surface of the coupling arm 732. In this manner, valve actuation motions applied to the second output rocker 708 (via the second input rocker 706 and second lost motion component 710) are conveyed to the first output rocker 408, whereas valve actuation motions applied to the first output rocker 408 via the first input rocker 406 and first lost motion component 410 are not conveyed to the second output rocker 732. Once again, the variations on the one way coupling 430 illustrated in FIGS. 4-6 may be equally applied to the one way coupling 730 illustrated in FIGS. 7 and 8.

As will be appreciated by those skilled in the art, the implementations of the rocker assemblies 402, 404, 704 in FIGS. 4-8 effectively provide end pivoting or Type II operation of each rocker assembly. As known in the art, a Type II rocker utilizes a rocker arm pivoting about one of its ends and imparting valve actuation motions at its other end, with the effort or valve actuation forces being applied to the rocker arm at a point intermediate to the pivot and load imparting ends. Thus, in the implementations of FIGS. 4-8, each of the rocker assemblies 402, 404, 704 exhibits Type II-like behavior in that the assembly rotates or pivots about a rocker shaft and imparts valve actuation motions at an opposing end of the assembly, where the assembly receives at least some valve actuation motions from a valve actuation motion source applied between its pivoting and motion imparting end points.

Figure 9:
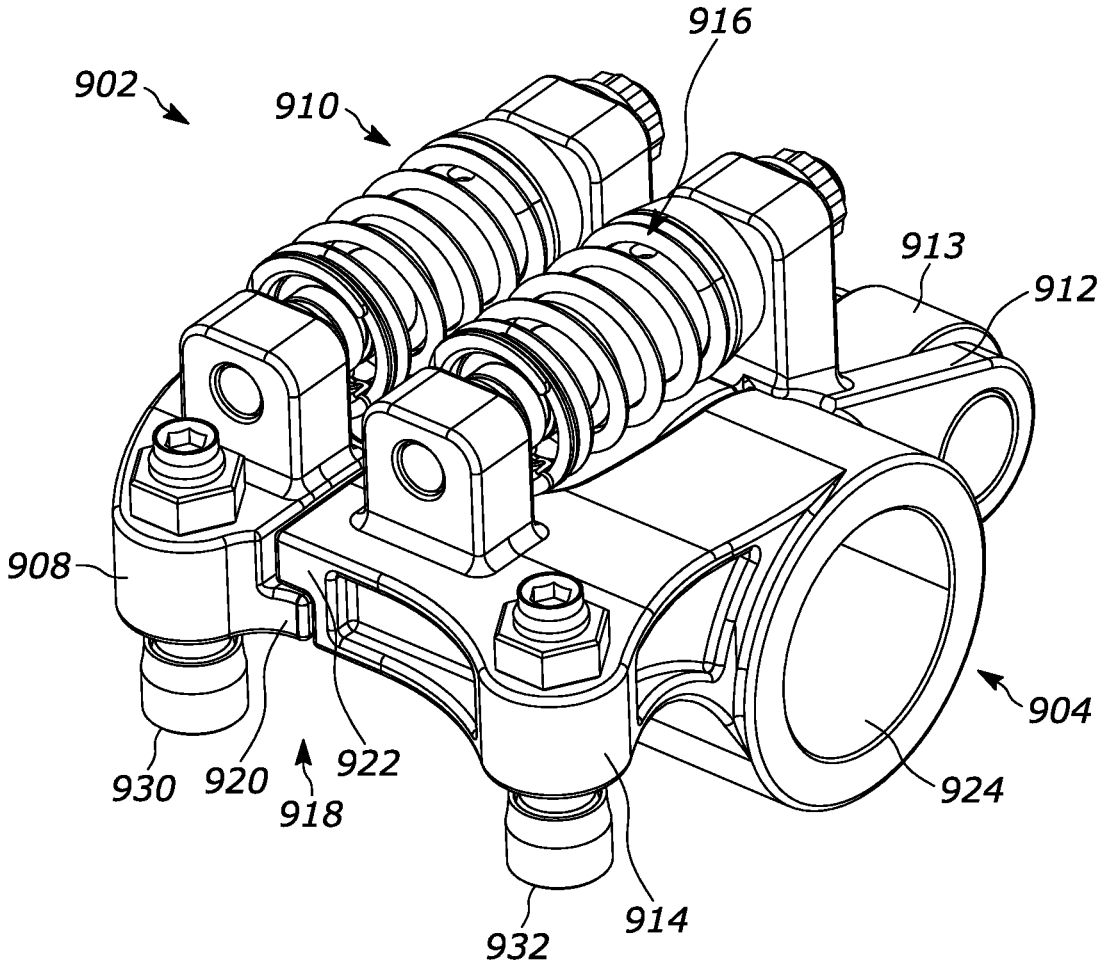
FIGS. 9-11 illustrate a third implementation of a valve actuation system also in accordance with the second embodiment of FIG. 2.
Figure 10:
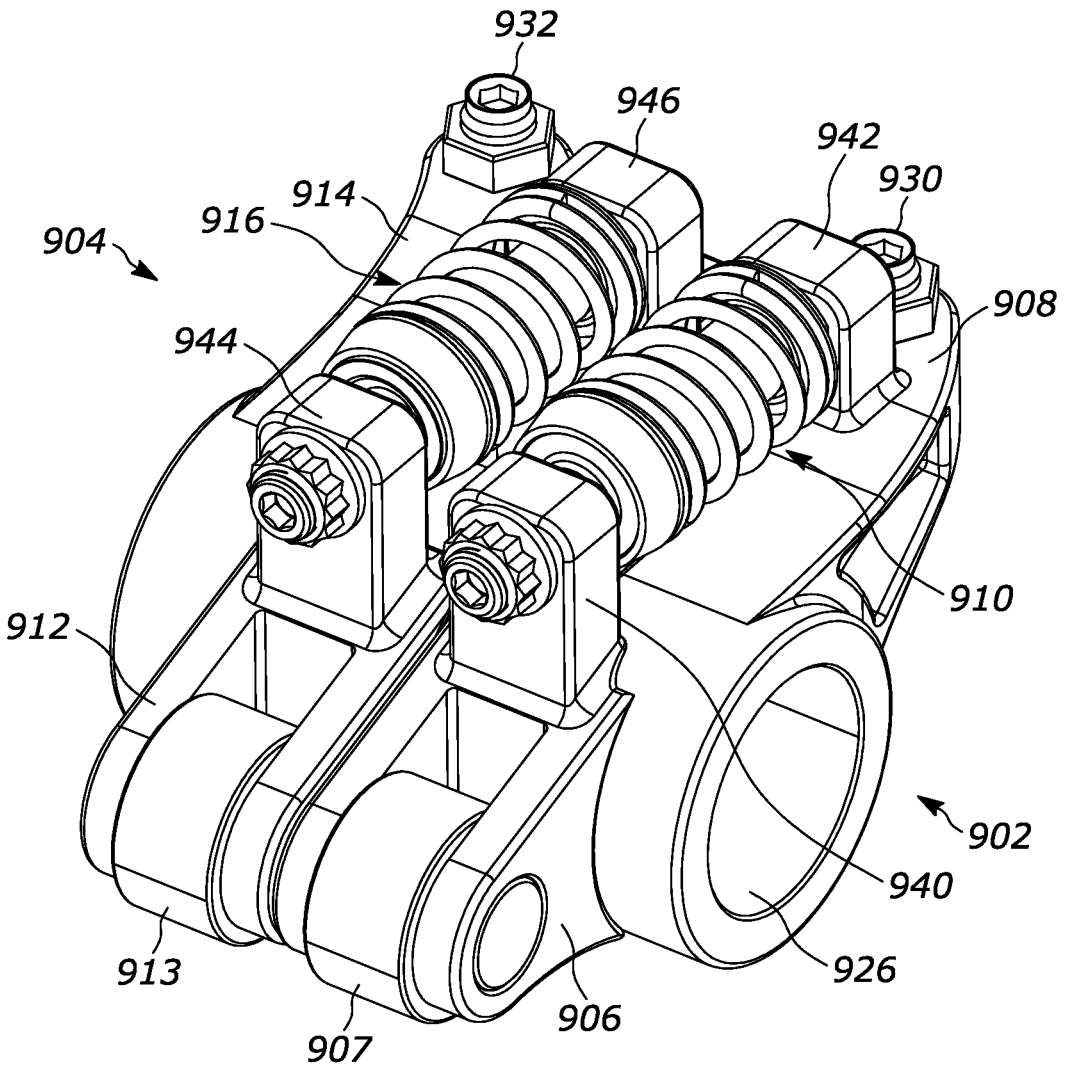
Figure 11:
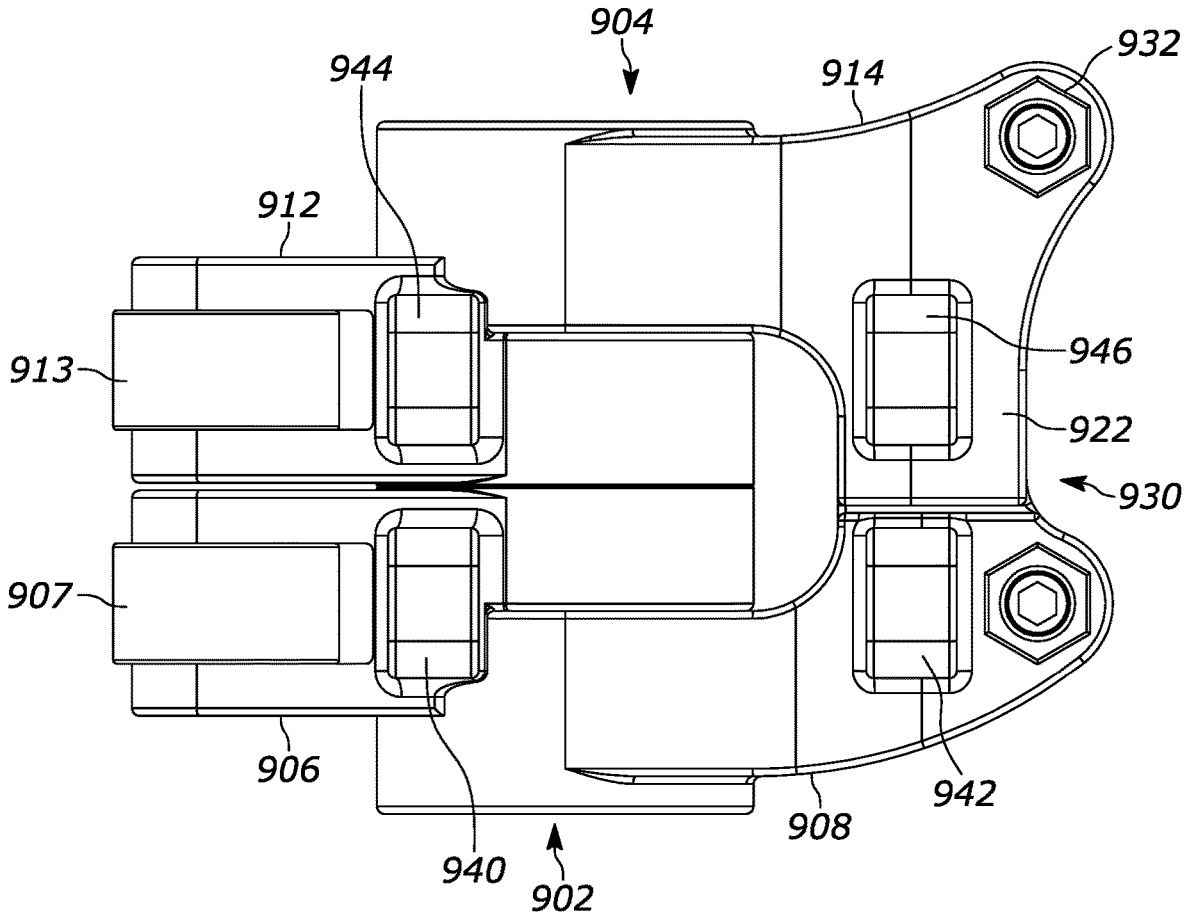

Referring now to FIGS. 9-11, a second implementation of a valve actuation system in accordance with the second embodiment of FIG. 2 is shown. In keeping with FIG. 2, the implementation shown in FIGS. 9-11 includes a first rocker assembly 902 and an adjacent second rocker assembly 904. Functionally, the implementation shown in FIGS. 9-11 is substantially identical to the implementation shown in FIGS. 7 and 8 in that the first rocker assembly 902 comprises a first input rocker 906, a first output rocker 908 and an intervening first lost motion component 910 operatively connected to first input rocker 906 and the first output rocker 908, and the second rocker assembly 904 comprises a second input rocker 912, a second output rocker 914 and an intervening second lost motion component 916 operatively connected to second input rocker 912 and the second output rocker 914. As best shown in FIGS. 10 and 11 each of the illustrated input rockers 906, 912 and output rockers 908, 914 includes a respective vertically-extending boss 940, 942, 944, 946 configured to receive respective ends of the first and second lost motion components 910, 916, as shown. In this case, hydraulic fluid supply to control operation of the respective lost motion components 910, 916 may be provided through suitable hydraulic passages (not shown) formed in any of the input rockers 906, 912 and output rockers 908, 914 and their corresponding bosses 940, 942, 944, 946.

In this implementation all of the illustrated input rockers 906, 912 and output rockers 908, 914 are shaft-mounted, half rocker arms. As best shown in FIGS. 9 and 10, respectively, the second output rocker 914 and the first output rocker 908 each comprise a rocker shaft bore 924, 924 that permits the respective output rockers 908, 914 to reciprocate about the rocker shaft. Although not shown in FIG. 9 or 10, each of the input rockers 906, 912 comprises similar rocker shaft bores that permit the respective input rockers 906, 912 to reciprocate about the rocker shaft. As best shown in FIG. 10, the respective input rockers 906, 912 each comprise a roller bearing 907, 913 for receiving valve actuation motions from respective first and second valve actuation motion sources (not shown), e.g., cams on a camshaft. Further, as best shown in FIG. 9, the respective output rockers 908, 914 each comprise a lash adjustment screw and swivel assembly 930, 932 similar to the implementation shown in FIGS. 7 and 8. Once again, however, it is appreciated that either or both of the lash adjustment screw and swivel assemblies 930, 932 may be replaced with a hydraulic lash adjuster provided that the corresponding first and/or second output rockers 908, 914 include one or more hydraulic passages configured to provide hydraulic fluid to such lash adjuster (s).

A feature of this implementation, as best illustrated in FIG. 11 (where, in a top-down view, the first and second lost motion components 910, 916 have been removed to better illustrate the rockers 906, 908, 912, 914) is that, unlike the implementation of FIGS. 7 and 8 where the input rockers 406, 706 are nested within their corresponding output rockers 408, 708, the input rockers 906, 912 have a side-by-side mounting relationship with their corresponding output rockers 908, 914.

It is noted that, from the point of view of the valve actuation motion source (applying valve actuation motions to the first and second input rockers 906, 912) and the first and second engine valves (receiving valve actuation motions from the first and second output rockers 908, 914), the first and second rocker assemblies 902, 904 operate like a Type 3 or center pivot rocker arms, as known in the art. In this case, to achieve such operation the first and second rocker assemblies 902, 904 each relies on the combination of two Type 3/center pivot rocker arms in conjunction with the corresponding first and second lost motion assembly 910, 916. That is, the first and second rocker assemblies 902, 904 may be thought of as a quasi- or compound-Type 3 rockers based on a combination of constituent Type 3 rockers.

Additionally, a one way coupling 930 is provided between the first and second rocker assemblies 902, 904. However, in this implementation, the one way coupling 918 comprises a pair of coupling arms 920, 922. In this case, a first coupling arm 920 is integrally formed in the first output rocker 908 and extends toward the second output rocker 914, whereas a second coupling arm 922 is integrally formed in the second output rocker 914 and extends toward the first output rocker 908. The extension of the first and second coupling arms 920, 922 is such that they have overlapping contact surfaces with the downward-facing contact surface of the second coupling arm 922 facing the upward-facing contact surface of the first coupling arm 920, as best shown in FIG. 9. Thus configured, the first rocker assembly 902, second rocker assembly 904 and one way coupling 918 operate in essentially the identical manner to the first rocker assembly 402, second rocker assembly 704 and once way coupling 730 illustrated in FIGS. 7 and 8.

As will be appreciated by those skilled in the art, an in contrast to the implementations illustrated with respect to FIGS. 4-8, the implementation of the rocker assemblies 902, 904 in FIGS. 9-11 effectively provide center pivoting or Type III operation of each rocker assembly. As known in the art, a Type III rocker utilizes a rocker arm pivoting about an intermediate point while receiving the effort or valve actuation motions at one end and imparting such valve actuation motions at its other end. Thus, in the implementation of FIG. 9-11, each of the rocker assemblies 902, 904 exhibits Type III-like behavior in that the assembly rotates or pivots about a rocker shaft while receiving at least some valve actuation motions at one end of the assembly and imparting such valve actuation motions at an opposing end of the assembly.

FIGS. 12-21 are cross-sectional illustrations of valve actuation systems employing the lost motion component 300' of FIG. 3A. In particular, FIGS. 12-21 illustrate an instance of the implementation of FIGS. 4-6 or FIGS. 7 and 8, though it is appreciated that the lost motion component 300' may be equally applied to the implementation shown in FIGS. 9-11. In the example shown in FIGS. 12-21, a first cam implementing a first valve actuation motion source is configured to provide two compression-release engine braking valve actuations 1206, 1208 as well as a BGR valve actuation 1210 and a second cam implementing a second valve actuation motion source is configured to provide a main exhaust valve actuation 1212, as known in the art.

Figure 12:
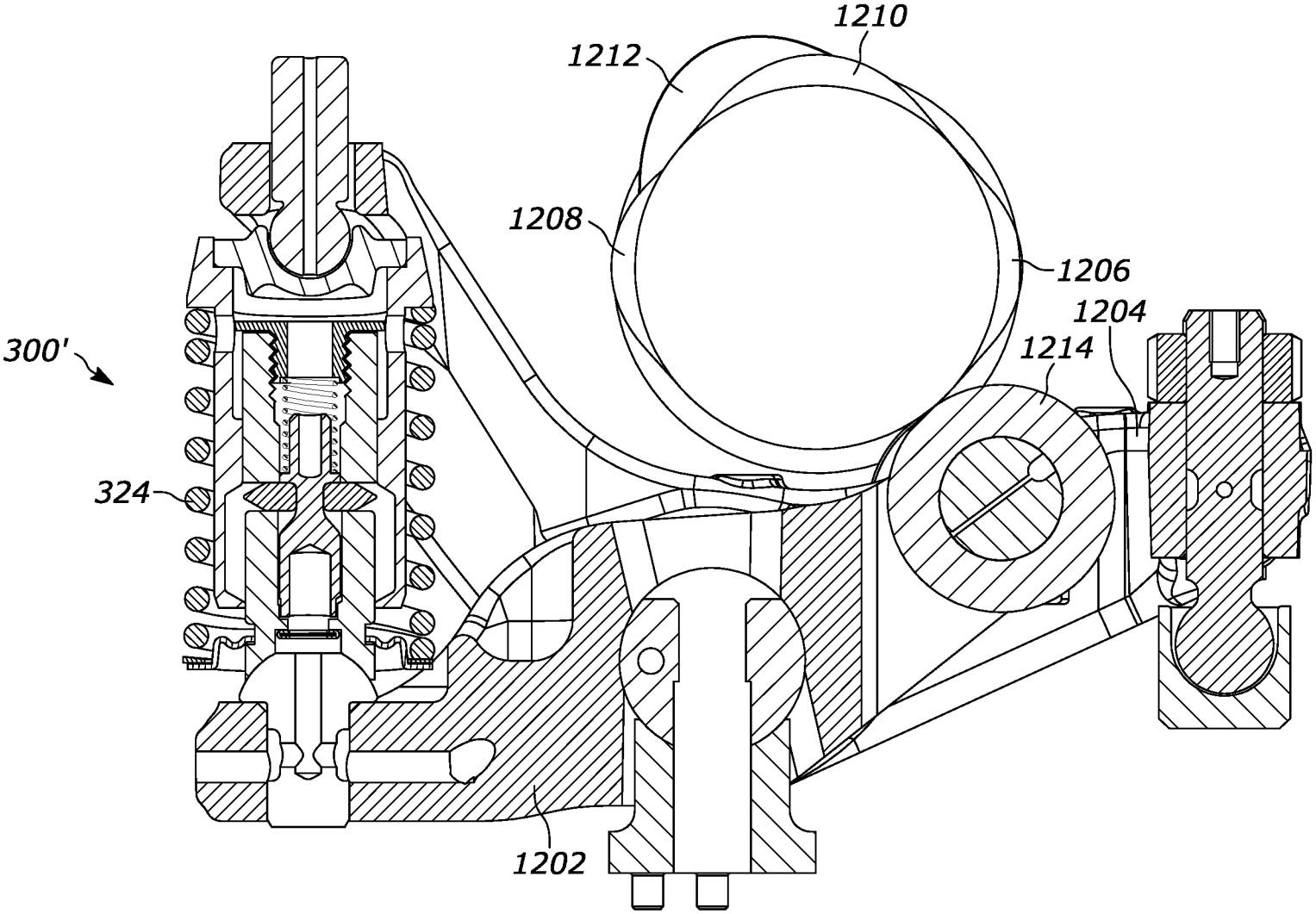
FIGS. 12-21 are cross-sectional illustrations of the implementation of FIGS. 4-6 or the implementation of FIGS. 7 and 8 in which the alternative lost motion component of FIG. 3A is employed.

FIG. 12 illustrates a first input rocker 1202 and a first output rocker 1204, where the first input rocker 1202 comprises a cam roller 1214 configured to receive valve actuation motions from the first valve actuation motion source.

Though not shown in FIGS. 12-21, a second rocker/second output rocker as well as a one-way coupling (as described above) are provided and configured to receive valve actuation motions from the second valve actuation motion source and to convey such valve actuations to the first output rocker 1204. As further shown, a lost motion component 300' in accordance with FIG. 3A is deployed between and operatively connected to the first input and first output rockers 1202, 1204.

FIG. 12 illustrates the condition in which the lost motion component 300' is in an unlocked state and both the first and second cams are at base circle. In this state, the plunger spring 324 freely biases the housing 320 and plunger 322' apart from each other and, in so doing, also biases the first input rocker 1202 into contact with the first cam and the first output rocker 1204 into contact with the engine valve(s) (not shown).

Figure 13:
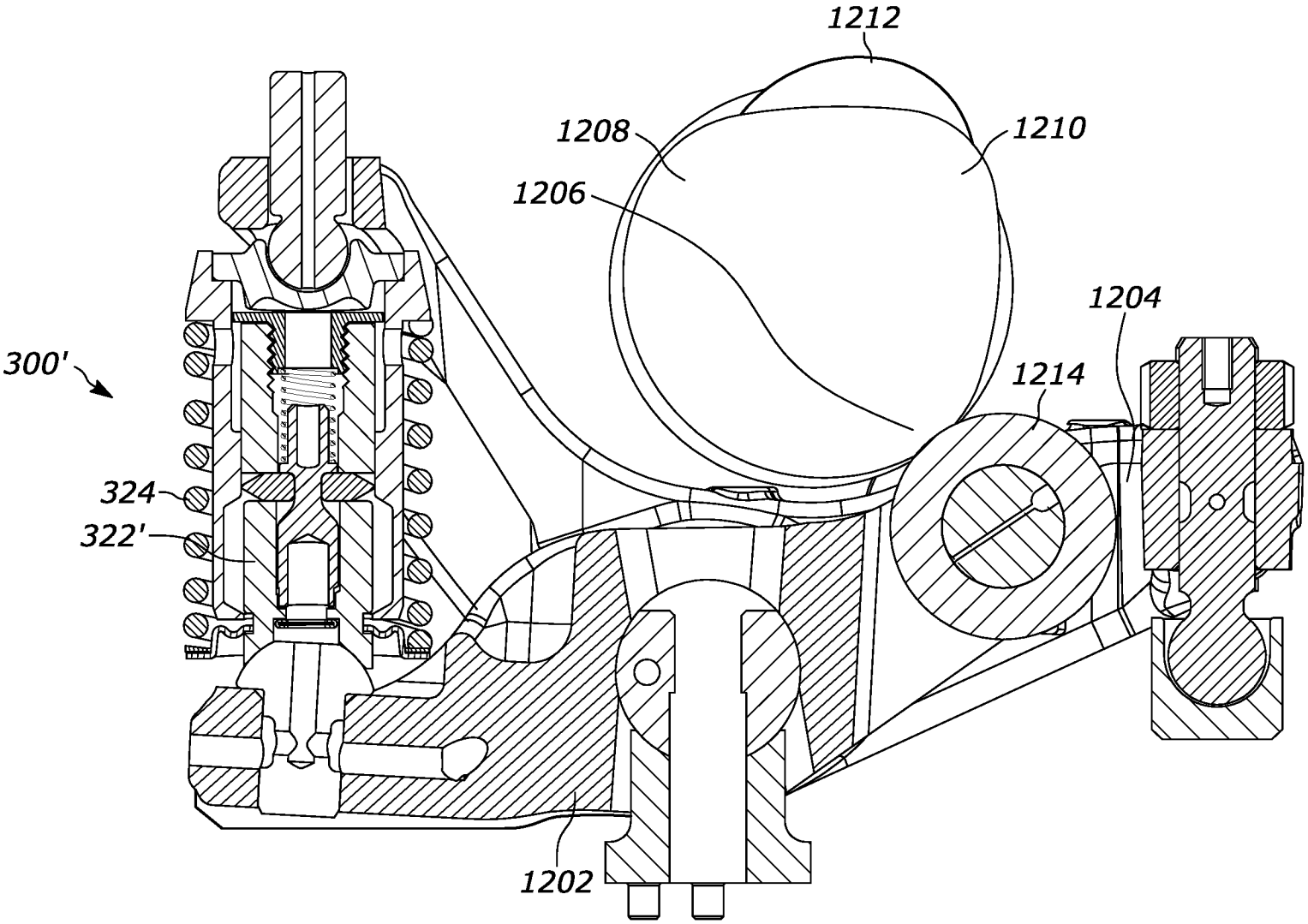
Figure 14:
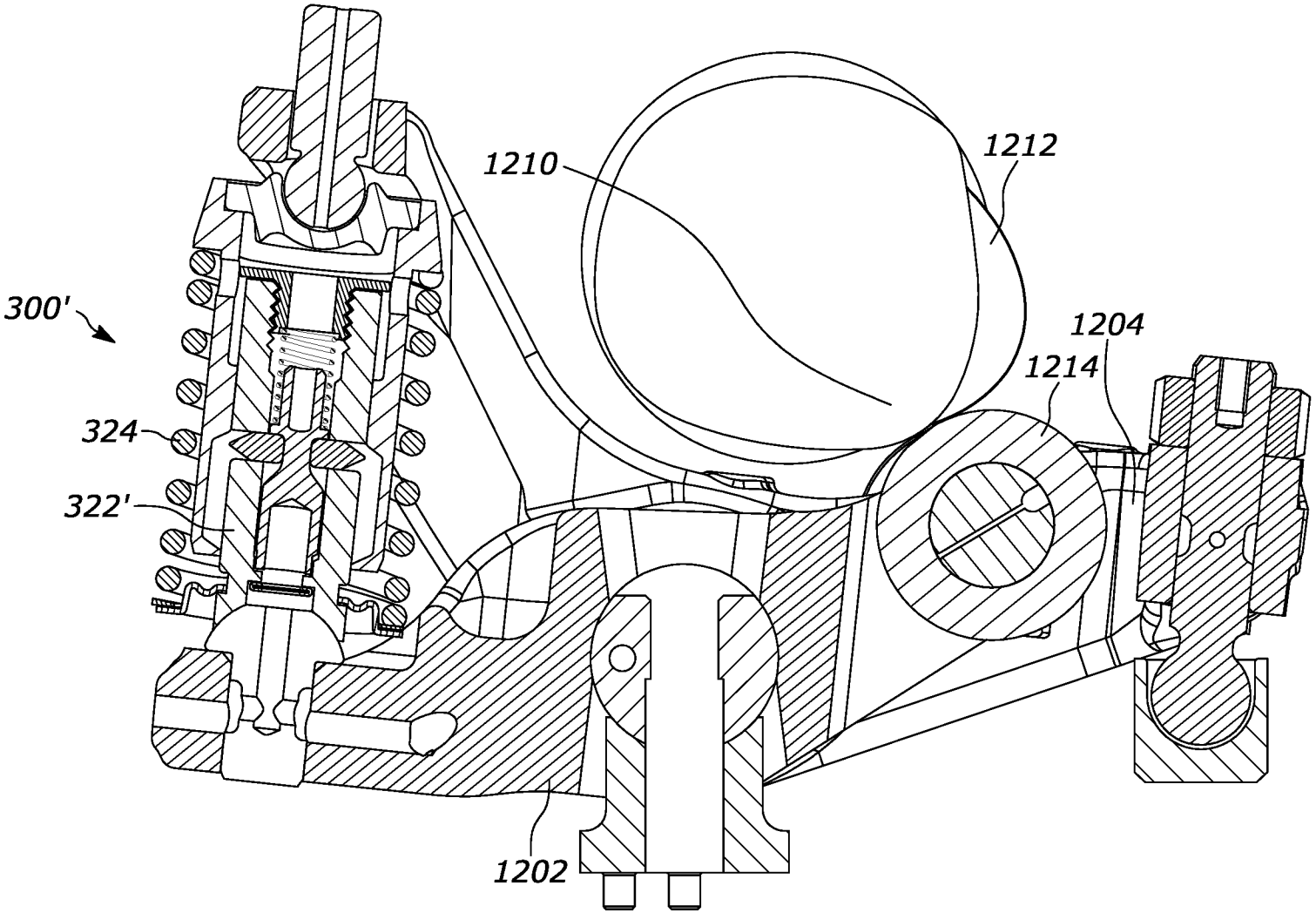
Figure 15:
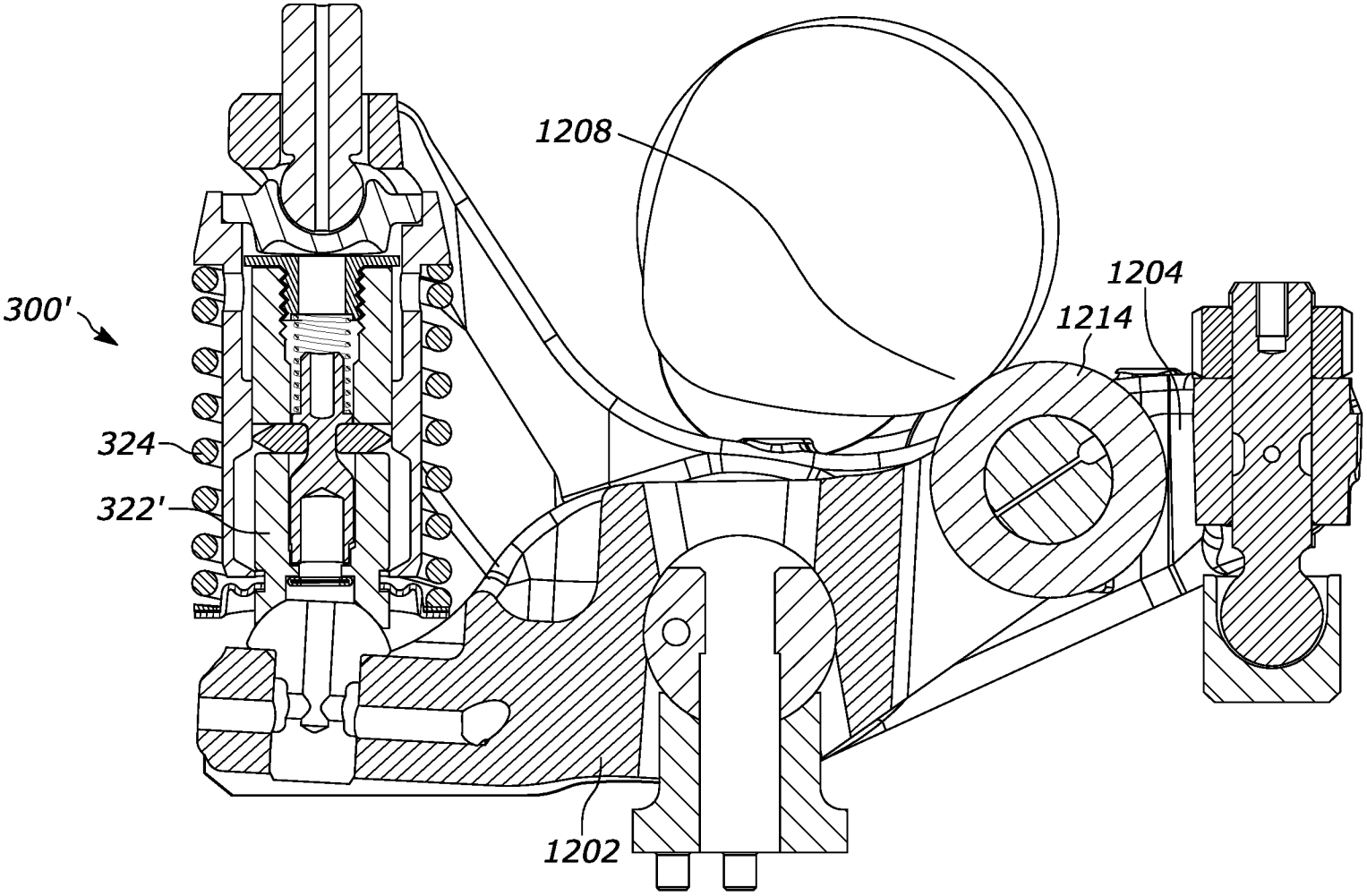

FIGS. 13-15 illustrate the condition in which the lost motion component 300' remains in the unlocked state and where the first cam respectively applies (i) the peak of the first compression-release valve actuation 1206 to the first input rocker 1202, (ii) the peak of the BGR valve actuation 1210 to the first input rocker 1202 and (iii) the peak of the second compression-release valve actuation 1208 to the first input rocker 1202. FIG. 14 additionally shows partial application of the main exhaust valve actuation 1212 being applied (via the one-way coupling) to the first output rocker 1204. In each of FIGS. 13-15, the applied valve actuation(s) result in the plunger 322' sliding within its bore and resulting in compression (FIGS. 13 and 15) or expansion (FIG. 14) of the plunger spring 324 relative to its initial state as shown in FIG. 12. In this manner, as described previously, the bias applied by the plunger spring 324 ensures continuous contact between the first rocker 1202 and first cam, as well as continuous contact between the lost motion component 300' and the first input and first output rockers 1202, 1204.

Figure 16:
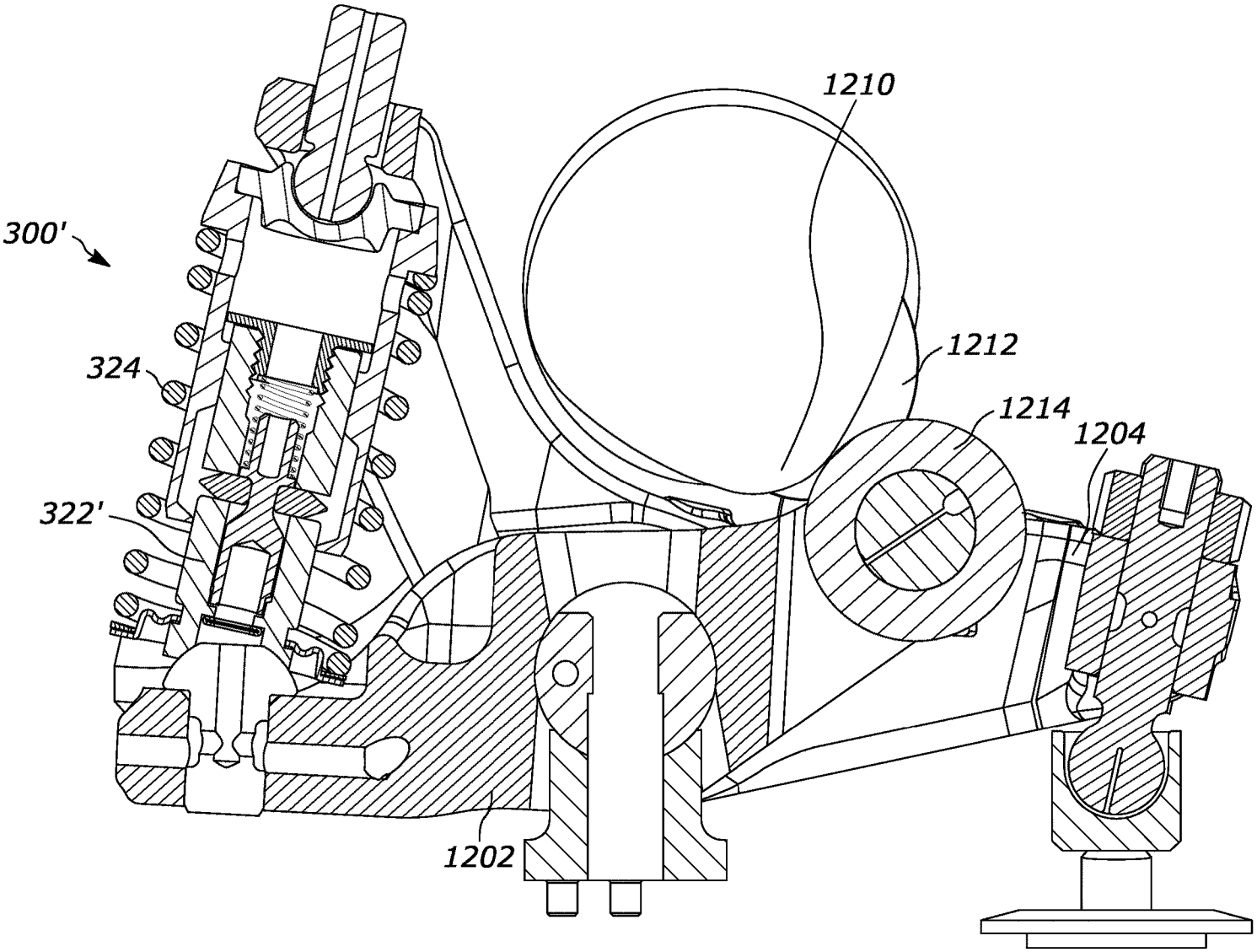

FIG. 16 illustrate the condition in which the lost motion component 300' remains in the unlocked state and where the first cam partially applies the BGR valve actuation 1210 to the first input rocker 1202 and the second cam applies the peak of the main exhaust valve actuation 1212 (again, via the one-way coupling) to the first output rocker 1204. A result of this occurrence is that the first output rocker 1204 is in a high lift state while the first input rocker 1202 is in a comparatively low lift state. In this state, the plunger spring 324 freely biases the housing 320 and plunger 322' even farther apart from each other and, once again, also biases the first input rocker 1202 into contact with the first cam and the first output rocker 1204 into contact with the engine valve(s) (not shown). That is, the lost motion component 300' is able to expand to a sufficient degree, under the bias provided by the plunger spring 324, so as to ensure continuous contact between the lost motion component 300' and the first input and first output rockers 1202, 1204, as well as ensuring continuous contact between the first input rocker 1202 and the first cam.

Figure 17:
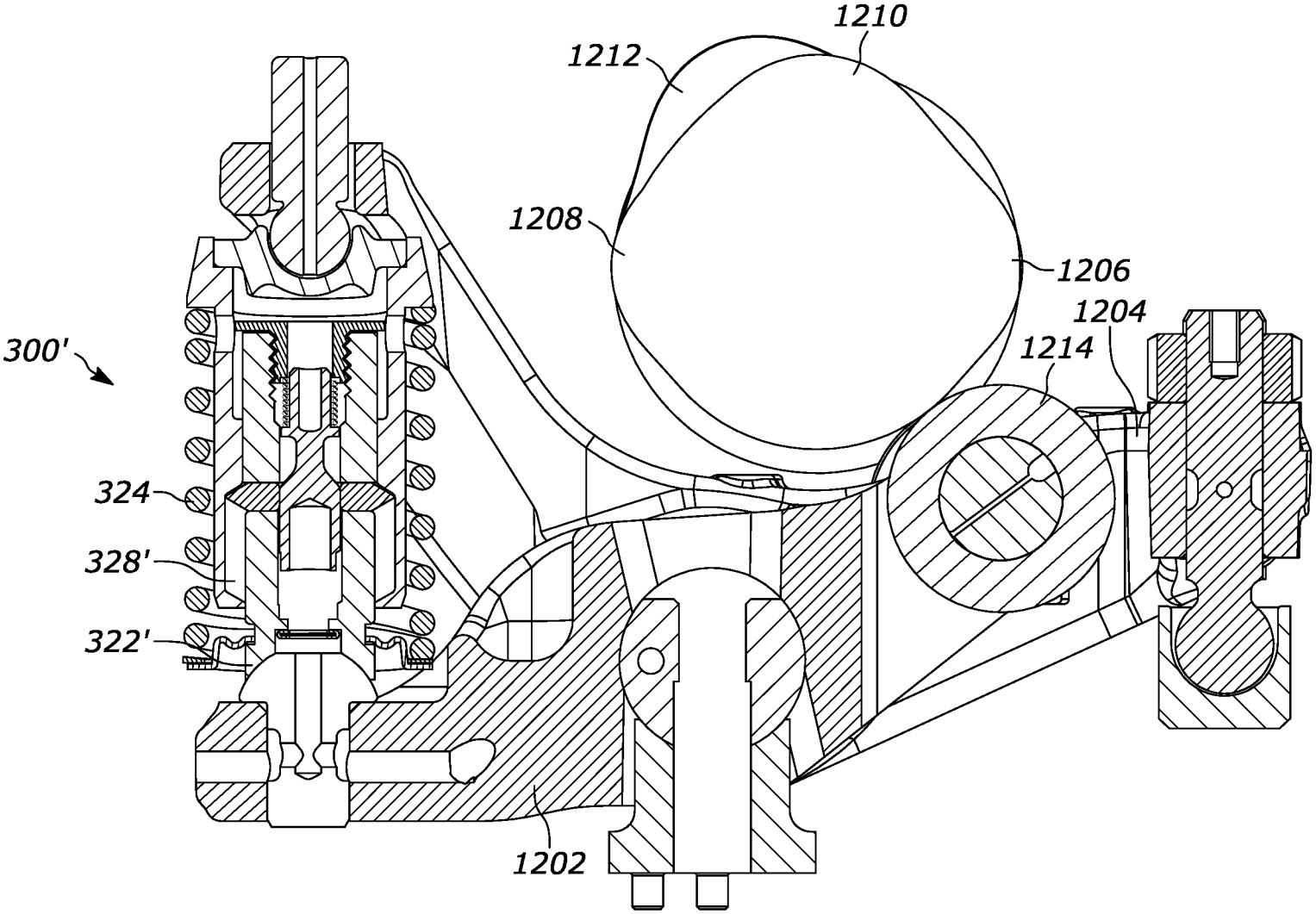
Figure 18:
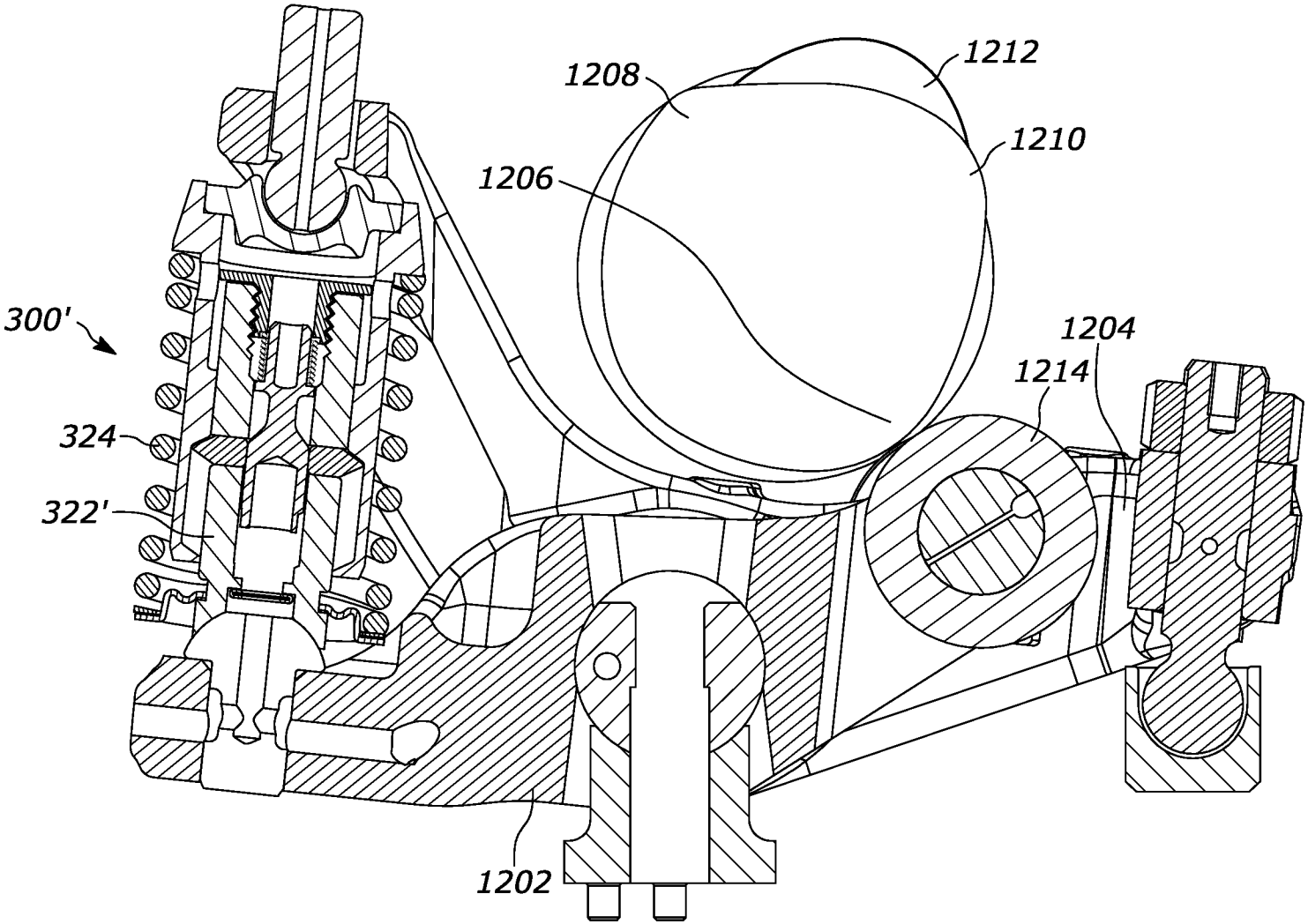

FIG. 17 illustrates a condition substantially equivalent to that illustrated in FIG. 12, with the exception that the first lost motion component 300' is maintained in its locked/motion conveying state. Despite this change in state of the lost motion component 300', the plunger spring 324 once again freely biases the housing 320 and plunger 322' apart from each other and, in so doing, also biases the first input rocker 1202 into contact with the first cam and the first output rocker 1204 into contact with the engine valve(s).

Figure 19:
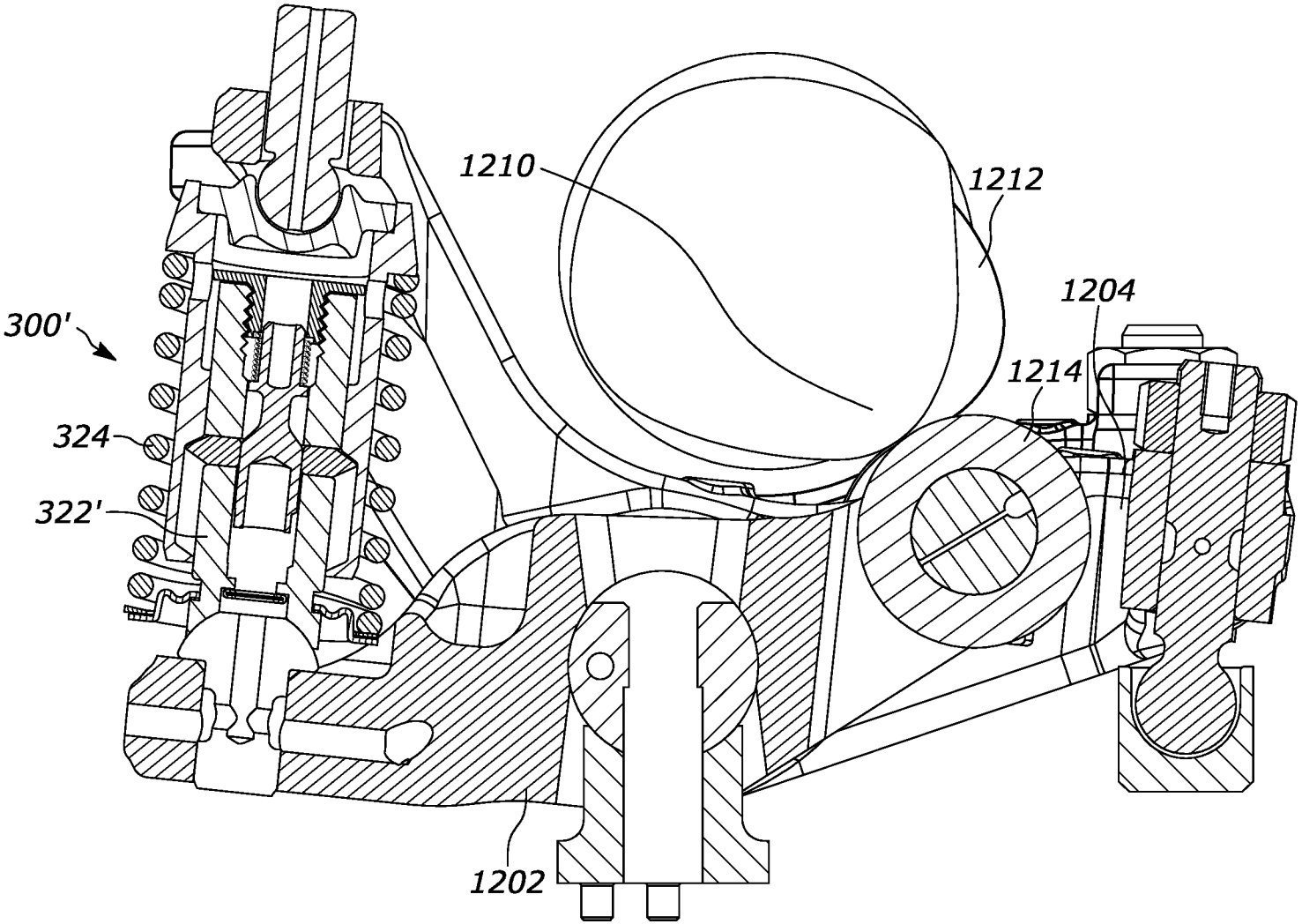
Figure 20:
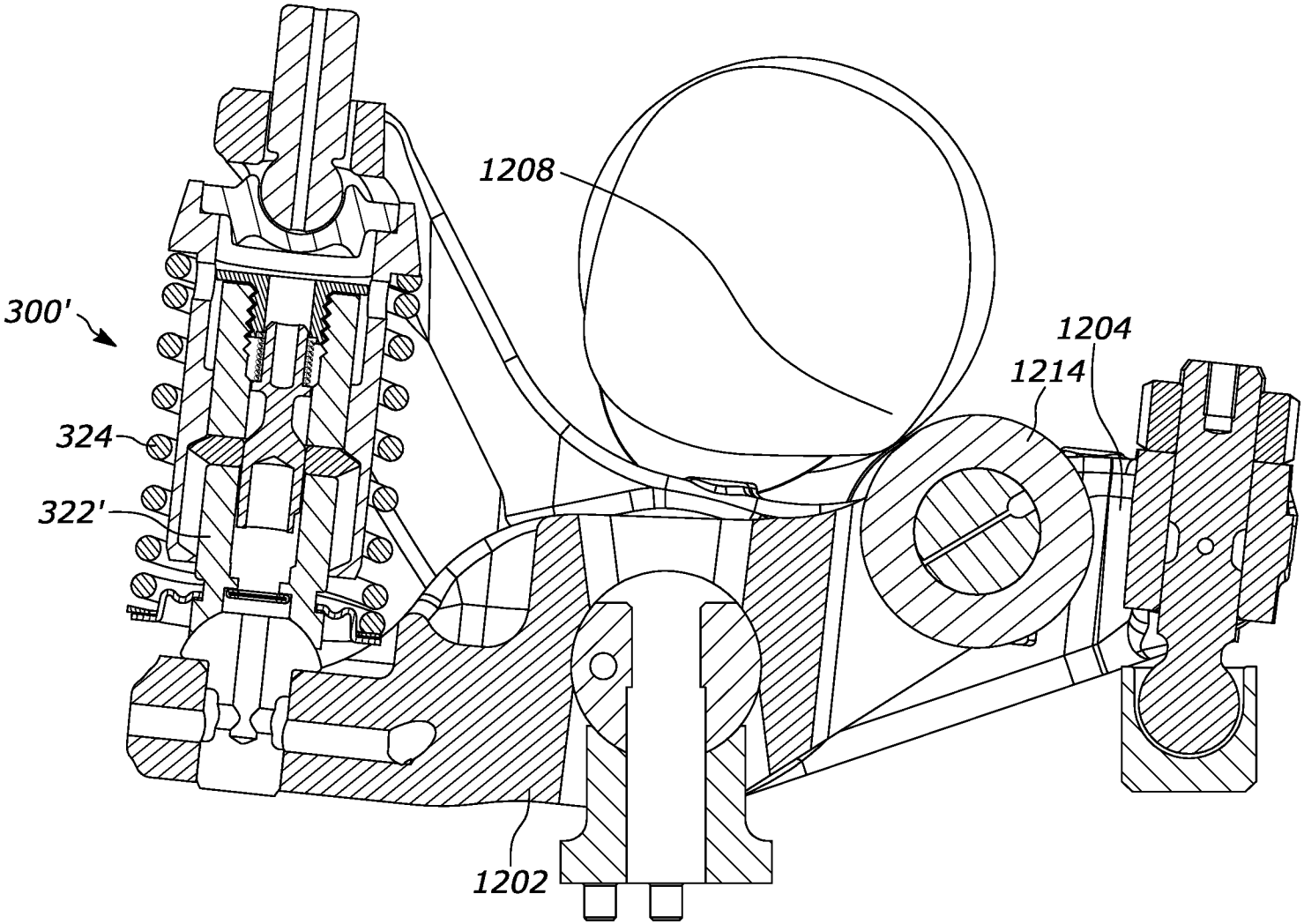
Figure 21:
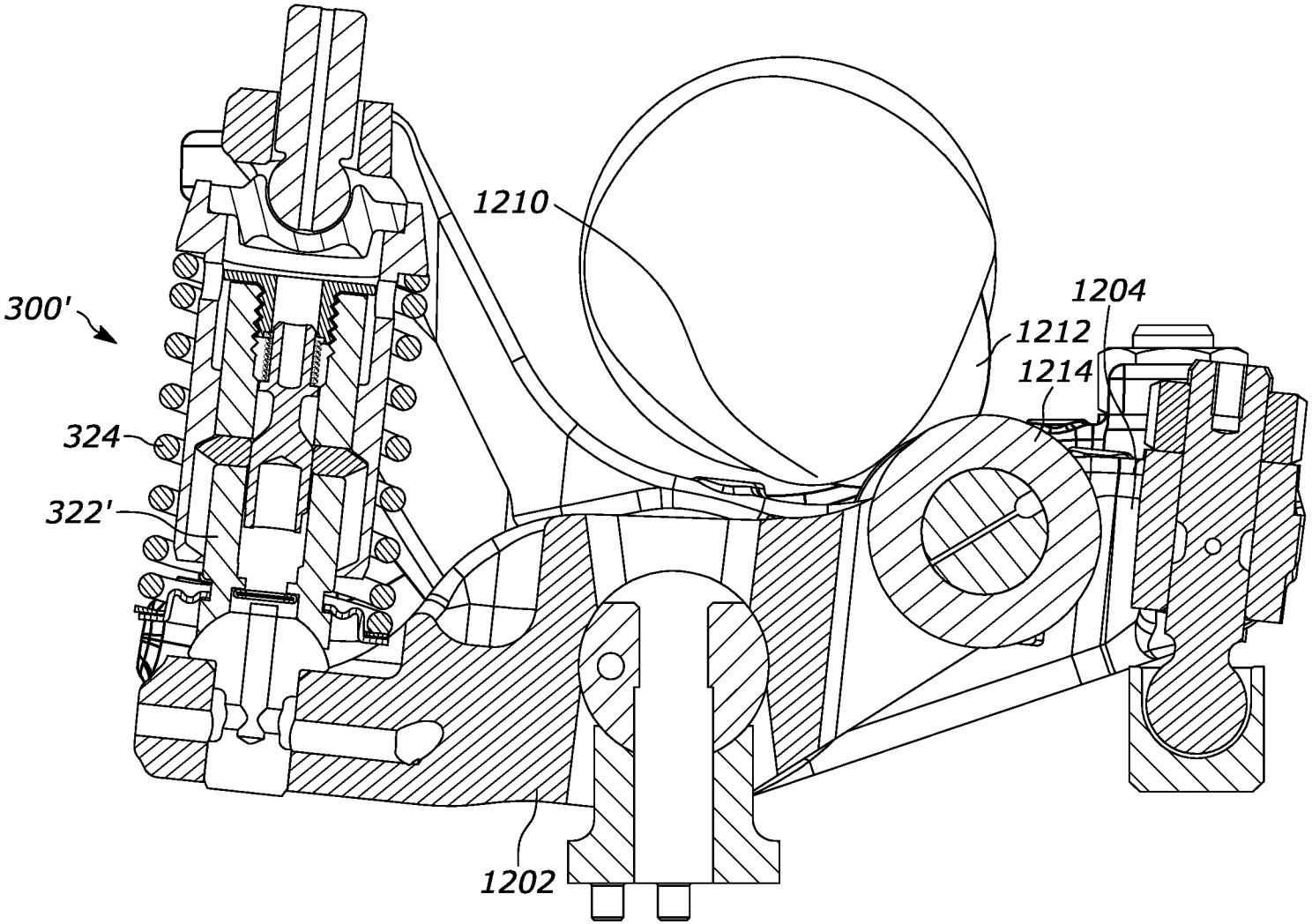

FIGS. 18-21 illustrate the condition in which the lost motion component 300' remains in the locked state and where the first cam respectively applies (i) the peak of the first compression-release valve actuation 1206 to the first input rocker 1202, (ii) the peak of the BGR valve actuation 1210 to the first input rocker 1202, (iii) the peak of the second compression-release valve actuation 1208 to the first input rocker 1202, and (iv) where the first cam partially applies the BGR valve actuation 1210 to the first input rocker 1202 and the second cam applies the peak of the main exhaust valve actuation 1212 (again, via the one-way coupling) to the first output rocker 1204. FIG. 19 additionally shows partial application of the main exhaust valve actuation 1212 being applied (via the one-way coupling) to the first output rocker 1204. In each of FIGS. 18-21, the applied valve actuation(s) result in the plunger 322' engaging with the housing 320 via interaction of the wedges 336 with an upper surface of the annular outer recess 338'. As a result, the various applied valve actuations are applied to engine valves.

Although not shown in FIGS. 17-21, depending on the configuration of the first and second cams, there may be instances in which the difference in lifts applied to the first input rocker 1202 (via the first cam) and the first output rocker 1204 (via the one-way coupling) will result in a tendency for the plunger 322' and housing 330 to separate from each other despite the lost motion component 300' being in the locked/motion conveying state. In these situations, the greater longitudinal length of the annular outer recess 338' still permits expansion of the lost motion component 300' despite the locked state, thereby ensuring maintenance of the lost motion component 300' between the first input and first output rockers 1202, 1204.

While the various embodiments in accordance with the instant disclosure have been described in conjunction with specific implementations thereof, it is evident that many alternatives, modifications and variations will be apparent to those skilled in the art. In the various embodiments described herein, the input and output rockers are depicted as pivoting about a rocker shaft. However, the instant disclosure need not be limited in this regard, and it is understood that pivoting arrangements other than about a rocker shaft may be equally employed. For example, the input and output rockers may respectively pivot about different shafts. Further, such shafts could even be mounted on other rocker arms or on separate shaft pedestals.

Accordingly, the preferred embodiments of the invention as set forth herein are intended to be illustrative only and not limiting so long as the variations thereof come within the scope of the appended claims and their equivalents.

What is claimed is:

1. A system for actuating at least two engine valves associated with a cylinder of an internal combustion engine, the system comprising:

a first rocker assembly operatively connected to a first valve actuation motion source and to a first engine valve of the at least two engine valves, the first rocker assembly comprising:

a first input rocker configured to receive first valve actuation motions from the first valve actuation motion source;

a first output rocker configured to impart the first valve actuation motions to the first engine valve, and a first lost motion component arranged in series between the first input rocker and the first output rocker, the first lost motion component configured to be selectively switched between a motion absorbing state in which conveyance of the first valve actuation motions from the first input rocker to the first output rocker is prevented, and, a motion conveying state in which conveyance of the first valve actuation motions from the first input rocker to the first output rocker is enabled;

a second rocker assembly operatively connected to a second valve actuation motion source and to a second engine valve of the at least two engine valves, the second rocker assembly comprising at least one second rocker configured to receive second valve actuation motions from the second valve actuation motion source and to impart the second valve actuation motions to the second engine valve; and a one-way coupling mechanism disposed between the first output rocker and the at least one second rocker such that the second valve actuation motions are transferred from the at least one second rocker to the first output rocker, and the first valve actuation motions are not transferred from the first output rocker to the at least one second rocker.

2. The system of claim 1, wherein the first output rocker includes a hydraulic lash adjuster.

3. The system of claim 1, wherein the at least one second rocker includes a hydraulic lash adjuster.

4. The system of claim 1, wherein the first rocker assembly is configured to operate as a Type II rocker.

5. The system of claim 1, wherein the first rocker assembly is configured to operate as a Type III rocker.

6. The system of claim 1, wherein the first input rocker and the first output rocker each include a shaft-mounted half rocker.

7. The system of claim 6, wherein the first output rocker further includes lateral arms defining a central opening configured to receive the first input rocker.

8. The system of claim 6, wherein the first output rocker and the first input rocker are deployed adjacent to each other.

9. The system of claim 1, wherein the at least one second rocker includes a shaft-mounted Type II rocker.

10. The system of claim 1, wherein the one-way coupling mechanism comprises:

a coupling contact surface of the first output rocker; and a coupling arm extending from the at least one second rocker, the coupling arm configured to engage the coupling contact surface.

11. The system of claim 1, wherein the first lost motion component includes a hydraulically controlled locking mechanism.

12. The system of claim 1, wherein the first lost motion component includes a spring configured to bias the first input rocker toward the first valve actuation motion source, and bias the first output rocker toward the first engine valve.

13. The system of claim 1, wherein the first lost motion component is further configured to provide a failsafe lift event.

14. The system of claim 1, wherein the at least one second rocker comprises:

a second input rocker configured to receive the second valve actuation motions from the second valve actuation motion source;

a second output rocker configured to impart the second valve actuation motions to the second engine valve, and a second lost motion component arranged in series between the second input rocker and the second output rocker, the second lost motion component configured to be selectively switched between a motion absorbing state in which conveyance of the second valve actuation motions from the second input rocker to the second output rocker is prevented, and a motion conveying state in which conveyance of the second valve actuation motions from the second input rocker to the second output rocker is enabled.

15. The system of claim 14, wherein the second output rocker includes a hydraulic lash adjuster.

16. The system of claim 14, wherein the second rocker assembly is configured to operate as a Type II rocker.

17. The system of claim 16, wherein the first rocker assembly is configured to operate as a Type II rocker.

18. The system of claim 14, wherein the second rocker assembly is configured to operate as a Type III rocker.

19. The system of claim 18, wherein the first rocker assembly is configured to operate as a Type III rocker.

20. The system of claim 14, wherein the second input rocker and the second output rocker each include a shaft-mounted half rocker.

21. The system of claim 20, wherein the second output rocker further includes lateral arms defining a central opening configured to receive the second input rocker.

22. The system of claim 20, wherein the second output rocker and the second input rocker are deployed adjacent to each other.

23. The system of claim 14, wherein the one-way coupling mechanism comprises:

a coupling contact surface of the first output rocker, and a coupling arm extending from the second output rocker, the coupling arm configured to engage the coupling contact surface.

24. The system of claim 14, wherein the second lost motion component includes a hydraulically controlled locking mechanism.

25. The system of claim 14, wherein the second lost motion component includes a spring configured to bias the second input rocker toward the second valve actuation motion source, and bias the second output rocker toward the second engine valve.

26. The system of claim 14, wherein the second lost motion component is further configured to provide a failsafe lift event.

* * * * *